US008832896B2

(12) United States Patent
Sandahl et al.

(10) Patent No.: US 8,832,896 B2
(45) Date of Patent: Sep. 16, 2014

(54) PAINT ROLLER EDGE GUARD

(75) Inventors: Jeffrey E. Sandahl, Buffalo, MN (US); Jeffrey Mark Smith, New Market, MN (US); Christopher Alan Jensen, Crystal, MN (US); Thomas Rainer Jeltsch, Friedrichshafen (DE)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 13/462,443

(22) Filed: May 2, 2012

(65) Prior Publication Data

US 2013/0111686 A1 May 9, 2013

Related U.S. Application Data

(60) Provisional application No. 61/482,407, filed on May 4, 2011, provisional application No. 61/482,405, filed on May 4, 2011, provisional application No. 61/514,370, filed on Aug. 2, 2011, provisional application No. 61/514,348, filed on Aug. 2, 2011.

(51) Int. Cl.

| | |
|---|---|
| ***B05C 17/02*** | (2006.01) |
| ***B05C 17/03*** | (2006.01) |
| ***B05C 1/00*** | (2006.01) |
| ***B05C 17/01*** | (2006.01) |

(52) U.S. Cl.

CPC ..... *B05C 1/00* (2013.01); *B05C 17/0308* (2013.01); *B05C 17/0222* (2013.01); *B05C 17/0316* (2013.01); *B05C 17/0341* (2013.01); *B05C 17/0217* (2013.01); *B05C 17/0333* (2013.01); *B05C 17/0103* (2013.01)

USPC ..... 15/114; 15/118; 15/230.11; 15/248.2

(58) Field of Classification Search

USPC ..... 15/114, 118, 230.11, 246, 248.2; 492/13, 19; 401/218–220

See application file for complete search history.

(56) References Cited

U.S. PATENT DOCUMENTS

| | | | |
|---|---|---|---|
| 375,919 | A | 1/1888 | Boyle |
| 756,695 | A | 4/1904 | Peterson |

(Continued)

FOREIGN PATENT DOCUMENTS

| | | | |
|---|---|---|---|
| DE | 3606939 | A1 * | 9/1987 |
| DE | 4009044 | A1 | 9/1991 |

(Continued)

OTHER PUBLICATIONS

DE3606939A1 (Abstract), 1987.*

(Continued)

*Primary Examiner* — Mark Spisich
*Assistant Examiner* — Andrew A Horton
(74) *Attorney, Agent, or Firm* — Christopher J. Volkmann; Kelly, Holt & Christenson, PLLC

(57) ABSTRACT

A paint roller apparatus is provided. In one example, the paint roller apparatus is configured to apply paint to a surface and includes a roller arm and a paint roller rotatably mounted on the roller arm about a roller axis. The paint roller has an end and a paint applicator surface. The paint roller apparatus includes a roller guard having at least one painting feature for applying paint to the surface. The roller guard is selectively movable between first and second positions. The first position comprises the painting feature disposed adjacent the end of the roller on a first side of the roller axis and the second position comprises the painting feature disposed adjacent the end of the roller on a second side of the roller axis.

6 Claims, 41 Drawing Sheets

(56) References Cited

U.S. PATENT DOCUMENTS

| | | | | | |
|---|---|---|---|---|---|
| 2,160,570 | A | | 5/1939 | Welt | |
| 2,763,022 | A | | 9/1956 | Glacken | |
| 2,799,886 | A | | 7/1957 | Bruneili et al. | |
| 2,866,212 | A | * | 12/1958 | White et al. | 15/88 |
| 2,907,061 | A | | 10/1959 | Whalen | |
| 3,052,910 | A | | 9/1962 | Kushner | |
| 3,175,241 | A | | 3/1965 | Singleton et al. | |
| 3,186,024 | A | | 6/1965 | McLemore | |
| 3,204,276 | A | | 9/1965 | Kennedy, Sr. | |
| 3,213,477 | A | | 10/1965 | Shafer | |
| 3,274,637 | A | | 9/1966 | Schulze | |
| 3,369,269 | A | * | 2/1968 | Deck et al. | 15/230.11 |
| 3,623,180 | A | | 11/1971 | Anderson | |
| 3,658,432 | A | | 4/1972 | Lanusse | |
| 3,685,084 | A | | 8/1972 | Bennett | |
| 3,832,749 | A | | 9/1974 | Hawk | |
| 4,063,325 | A | | 12/1977 | Lizak | |
| 4,091,493 | A | | 5/1978 | Weiss | |
| 4,100,642 | A | * | 7/1978 | Gabor | 15/114 |
| 4,528,712 | A | * | 7/1985 | Leibow | 15/118 |
| 4,732,503 | A | | 3/1988 | Bader et al. | |
| 5,090,085 | A | | 2/1992 | Jarecki et al. | |
| 5,139,357 | A | | 8/1992 | Reents | |
| 5,246,302 | A | | 9/1993 | Wey | |
| 5,265,969 | A | * | 11/1993 | Chuang | 403/94 |
| 5,400,459 | A | | 3/1995 | Jarecke et al. | |
| 5,444,891 | A | | 8/1995 | Benson | |
| 5,496,123 | A | | 3/1996 | Gaither | |
| 5,503,307 | A | | 4/1996 | Wilson et al. | |
| 5,623,740 | A | | 4/1997 | Burns et al. | |
| 5,864,918 | A | | 2/1999 | Kosick | |
| 6,687,945 | B2 | | 2/2004 | Robinson | |
| 6,742,212 | B2 | | 6/2004 | Pyles | |
| 6,925,674 | B2 | | 8/2005 | Prince et al. | |
| 7,309,184 | B2 | | 12/2007 | Butcher et al. | |
| 7,340,796 | B2 | | 3/2008 | Pyles | |
| 7,556,447 | B2 | | 7/2009 | Bruggeman et al. | |
| D649,358 | S | | 11/2011 | Bruno et al. | |
| 2001/0049852 | A1 | * | 12/2001 | Burns et al. | 15/144.1 |
| 2002/0187273 | A1 | * | 12/2002 | Robinson | 427/428 |
| 2002/0194691 | A1 | * | 12/2002 | Meyer | 15/230.11 |
| 2003/0196286 | A1 | | 10/2003 | Pyles | |
| 2003/0200617 | A1 | | 10/2003 | Pyles | |
| 2003/0233721 | A1 | * | 12/2003 | Prince et al. | 15/230.11 |
| 2004/0068814 | A1 | * | 4/2004 | Pyles | 15/114 |
| 2004/0211016 | A1 | * | 10/2004 | Pyles | 15/114 |
| 2006/0130261 | A1 | | 6/2006 | Futo et al. | |
| 2008/0101850 | A1 | | 5/2008 | Wojcik et al. | |
| 2008/0223292 | A1 | | 9/2008 | Ling | |
| 2010/0180817 | A1 | * | 7/2010 | Atiya | 118/258 |
| 2011/0020050 | A1 | | 1/2011 | Sandahl et al. | |

FOREIGN PATENT DOCUMENTS

| | | | |
|---|---|---|---|
| DE | 4419672 | C1 | 8/1995 |
| DE | 20305209 | U1 | 6/2003 |
| DE | 10 2007 030 632 | B3 | 1/2009 |
| DE | 102010030461 | A1 | 12/2011 |
| WO | 94/00245 | A1 | 1/1994 |
| WO | 03/089154 | A1 | 10/2003 |
| WO | 2006/044256 | A1 | 4/2006 |
| WO | 2009/088539 | A1 | 7/2009 |
| WO | 2011/160869 | A1 | 12/2011 |

OTHER PUBLICATIONS

DE3606939A1 (Translation), 1987.*

Annex to Form PCT/ISA/206 Communication Relating to the Results of the Partial International Search for PCT Application No. PCT/US2012/036259, dated Sep. 19, 2012, 4 pages.

Invitation to Pay Additional Fees and, where applicable, Protest Fee for PCT Application No. PCT/US2012/036259, dated Sep. 19, 2012, 4 pages.

International Search Report and Written Opinion for PCT Application No. PCT/US2012/036259, dated Dec. 7, 2012, 18 pages.

International Preliminary Report on Patentability including Written Opinion of the International Searching Authority for PCT application No. PCT/US2012/036259, dated Nov. 14, 2013, 12 pages.

Search Report from European patent application No. 14161209.3 from Jun. 17, 2014, 7 pages.

* cited by examiner

PAINT ROLLER EDGE GUARD

CROSS-REFERENCE TO RELATED APPLICATIONS

The present application is based on and claims the benefit of U.S. provisional patent application Ser. No. 61/482,407, filed May 4, 2011, U.S. provisional patent application Ser. No. 61/482,405, filed May 4, 2011, U.S. provisional patent application Ser. No. 61/514,348, filed Aug. 2, 2011, and U.S. provisional patent application Ser. No. 61/514,370, filed Aug. 2, 2011, the contents of which are hereby incorporated by reference in their entirety.

BACKGROUND

Devices for applying a coating material, such as paint, to a surface typically include, but are not limited to, a coating applicator in the form of a brush, pad, roller, wheel, or combinations thereof. Painting devices can be used in a wide range of painting applications such as painting interior walls or ceilings within a building as well as painting exterior building surfaces.

The discussion above is merely provided for general background information and is not intended to be used as an aid in determining the scope of the claimed subject matter.

SUMMARY

In one exemplary embodiment, a paint roller apparatus configured to apply paint to a surface includes a roller arm and a paint roller rotatably mounted on the roller arm about a roller axis. The paint roller has an end and a paint applicator surface. The paint roller apparatus includes a roller guard having at least one painting feature for applying paint to the surface. The roller guard is selectively movable between first and second positions. The first position comprises the painting feature disposed adjacent the end of the roller on a first side of the roller axis and the second position comprises the painting feature disposed adjacent the end of the roller on a second side of the roller axis.

The roller guard can include an arm portion and a head portion having the at least one painting feature. The head portion can be rotatably coupled to the arm portion about a first axis. The first axis can be substantially parallel to the roller axis. The first axis can be substantially perpendicular to the roller axis.

The arm portion can be rotatable about a second axis to move the head portion between a first position in which the head portion is adjacent the end of the roller and a second position in which the head portion is spaced away from the end of the roller.

The paint roller apparatus can include a locking feature configured to selectively lock the head position in either the first position or the second position.

The head portion can include one or more mechanical stops configured to limit rotation of the head portion with respect to the arm portion. The roller guard can include at least one detent features that affects rotation of the head portion.

The at least one painting feature can include a brush disposed along a first edge of the roller guard. A second edge of the roller guard, facing a direction generally opposite the first edge, can be free of brushes.

In one exemplary embodiment, a paint roller shield includes a first portion couplable to a paint roller apparatus and a second portion having at least one painting feature, the second portion being rotatably coupled to the first portion.

The first portion can be rotatably couplable to the paint roller apparatus. The first portion can be pivotable with respect to the paint roller apparatus about a first axis, and the second portion can be pivotable with respect to the first portion about a second, different axis.

The at least one painting feature can include at least one brush disposed along a first edge of the second portion. The at least one painting feature can include a plurality of separate brushes, each having a plurality of bristles extending from the first edge of the second portion. A second, opposite edge of the second portion, can be free of brushes.

The paint roller shield can include one or more mechanical stops configured to limit rotation of the second portion with respect to the first portion. The paint roller shield can include at least one detent features that affects rotation of the second portion with respect to the first portion.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIGS. 2-1 and 2-2 are perspective views of the painting device illustrated in FIG. 1.

FIG. 2-3 is a perspective view of a pump assembly of the device illustrated in FIG. 1, under one embodiment.

FIG. 2-4 is a perspective view of a trigger of the device illustrated in FIG. 1, under one embodiment.

FIG. 3 is a perspective view of a painting device having a powered paint pump, under one embodiment.

FIG. 4 is a perspective view illustrating a tuck-in plunger rod, under one embodiment.

DETAILED DESCRIPTION OF ILLUSTRATIVE EMBODIMENTS

The present disclosure generally relates to devices for applying a liquid coating material, such as paint, to a surface and more specifically, but not by limitation, to painting devices suitable for interior painting applications such as painting walls and ceilings inside a building. As used herein, "paint" includes substances composed of coloring matter or pigment suspending in a liquid medium as well as substances that are free of coloring matter or pigment. "Paint" can also include preparatory coatings, such as primers. Some particular examples of paint include, but are not limited to, latex paint, oil-based paint, stain, lacquers, varnish, inks, and the like.

Paint can be applied to a surface as a liquid, and the coating provided can be opaque, transparent, or semi-transparent. Various embodiments described herein include a paint applicator or head having an applicator surface for applying paint in liquid form. Examples of paint applicators include, but are not limited to, rollers, pads, brushes, and the like. It is noted that while some embodiments are illustrated below using a paint roller, other types of paint applicators can be utilized and are within the scope of the concepts described herein.

Figure 1:
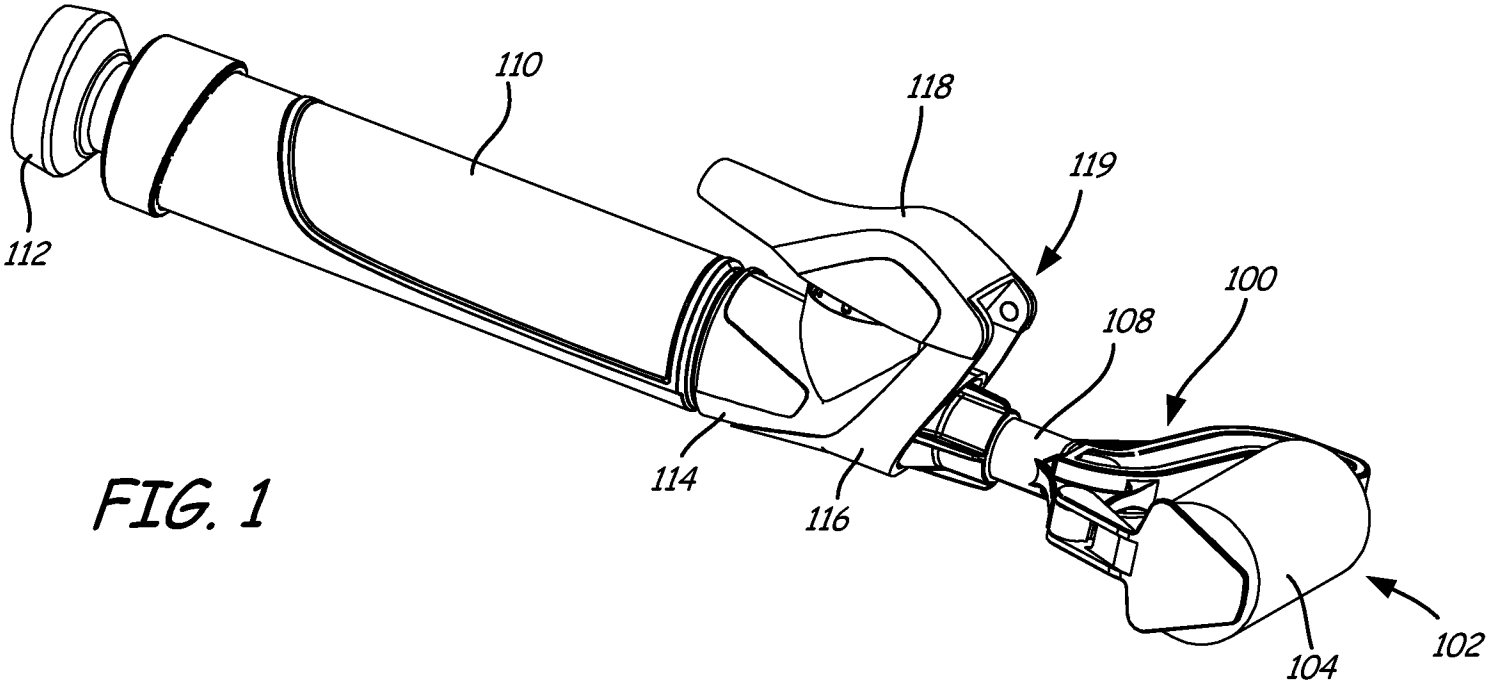
FIG. 1 is a perspective view of a painting device having a paint pump, under one embodiment.
Figures 1, 2:
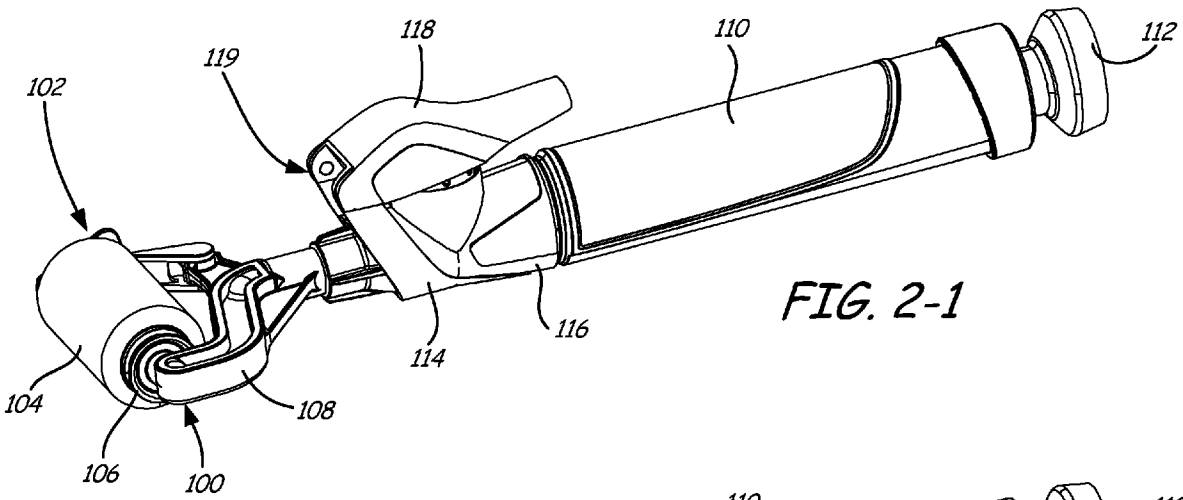
Figure 2:
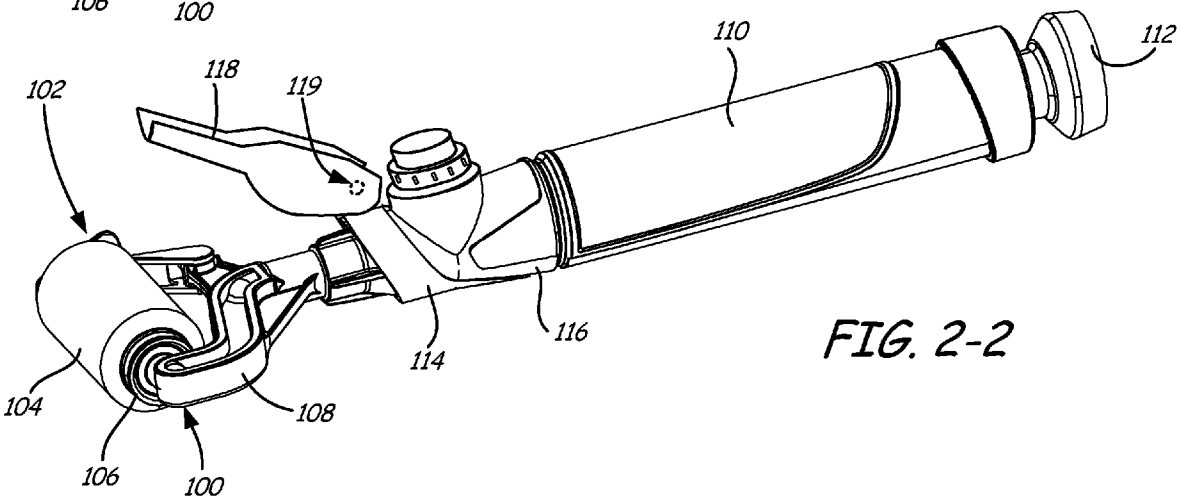

FIGS. 1, 2-1, and 2-2 are perspective views of an exemplary device 100 for applying a coating material, such as paint, to a surface. Painting device 100 includes a paint applicator or head 102 in the form of a roller having a roller cover 104 positioned on a roller core 106. Core 106 is rotatably mounted on a roller arm assembly 108. Roller cover 104 can be formed of any suitable material such as, but not limited to, foam, nylon, mohair, wool, and/or other suitable natural or synthetic fibers. The nap length and density of roller cover 104 can be selected based on the particular painting application.

Device 100 includes a tube 110 having an internal paint reservoir. Tube 110 forms a handle for the user to operate device 100 and can be any suitable length, size, and shape. In one embodiment, the exterior surface of tube 110 has a circular shape. In another embodiment, the exterior surface of tube 110 has a non-circular shape, such as elliptical or oval. Paint from the paint reservoir is internally fed to roller cover 104 through assembly 108. Roller cover 104 is perforated to allow paint to pass from the roller core 106 to the exterior applicator surface of roller cover 104.

Device 100 includes a knob 112 on an end of a shaft or rod of a plunger assembly extending within tube 110. The rod is configured to move a plunger or piston disposed within tube 110. By way of example, pulling knob 112 away from tube 110 moves the plunger within the tube 110 to expand the internal paint reservoir, for example when the user is filling the fluid reservoir.

Device 100 includes a fluid pump assembly 114 for pumping paint from the fluid reservoir. Pump assembly 114 is illustratively a positive displacement pump positioned between tube 110 and roller arm assembly 108. In the embodiment illustrated in FIG. 1, pump assembly 114 includes an outer casing 116 and a trigger 118 pivotably connected to casing 116 at a joint 119. Pump assembly 114 is manually operated by a user pressing trigger 118, which actuates a plunger or piston of the pump assembly 114 thereby pumping a portion of the paint from tube 110 through roller arm assembly 108 to the roller cover 104. In another embodiment, pump assembly 114 can be electrically powered using a direct current (DC) or alternating current (AC) power source.

The position of pump assembly 114 allows the user to hold the device 100 in either a left-hand or right-hand orientation and actuate the trigger 118 with either their thumb or fingers. The positioning of pump assembly 114 between tube 110 and the paint applicator 102 allows one-handed operation of device 100. By way of illustration, but not limitation, the user can grasp the device 100 with one hand between tube 110 and applicator 102. The one hand can be used to operate the pump assembly 114, while the proximity of the user's hand to applicator 102 provides enhanced control over the device movement while painting.

Trigger 118 is movable between a first, operating position (illustrated in FIG. 2-1) in which trigger 118 is used to actuate the pump assembly 114 and a second, pump removal position (illustrated in FIG. 2-2). In the second position, trigger 118 is pivoted about joint 119 away from pump assembly 114 exposing pump assembly components for removal. Removal of pump assembly components is described in further detail below.

Figures 2, 3:
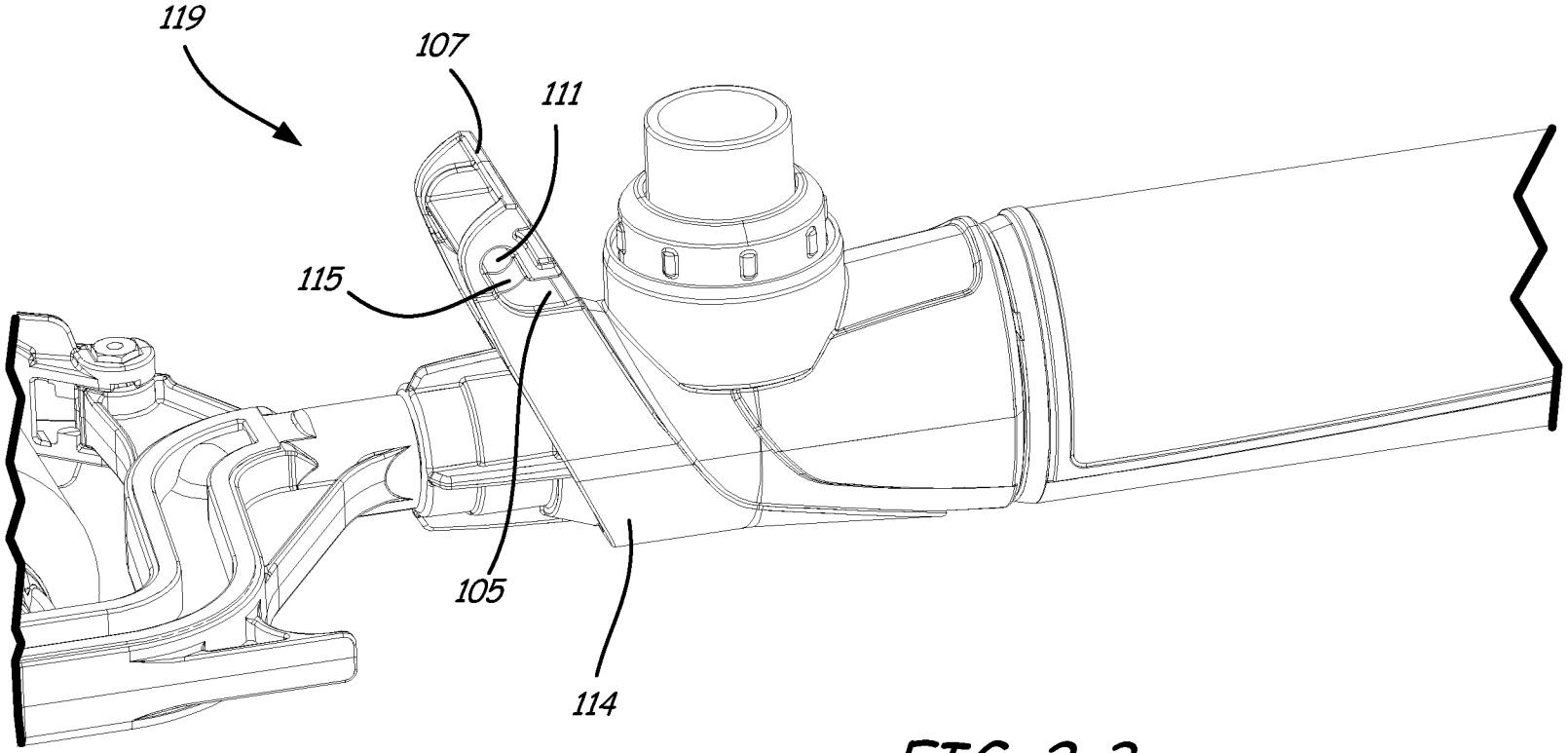
Figures 2, 3, 4:
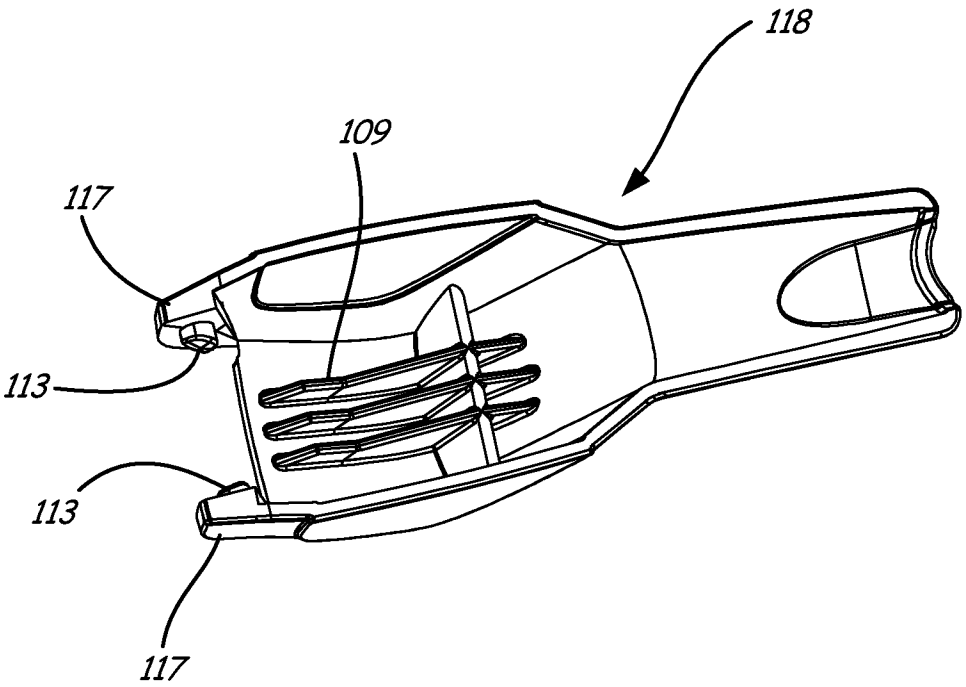
Figure 3:
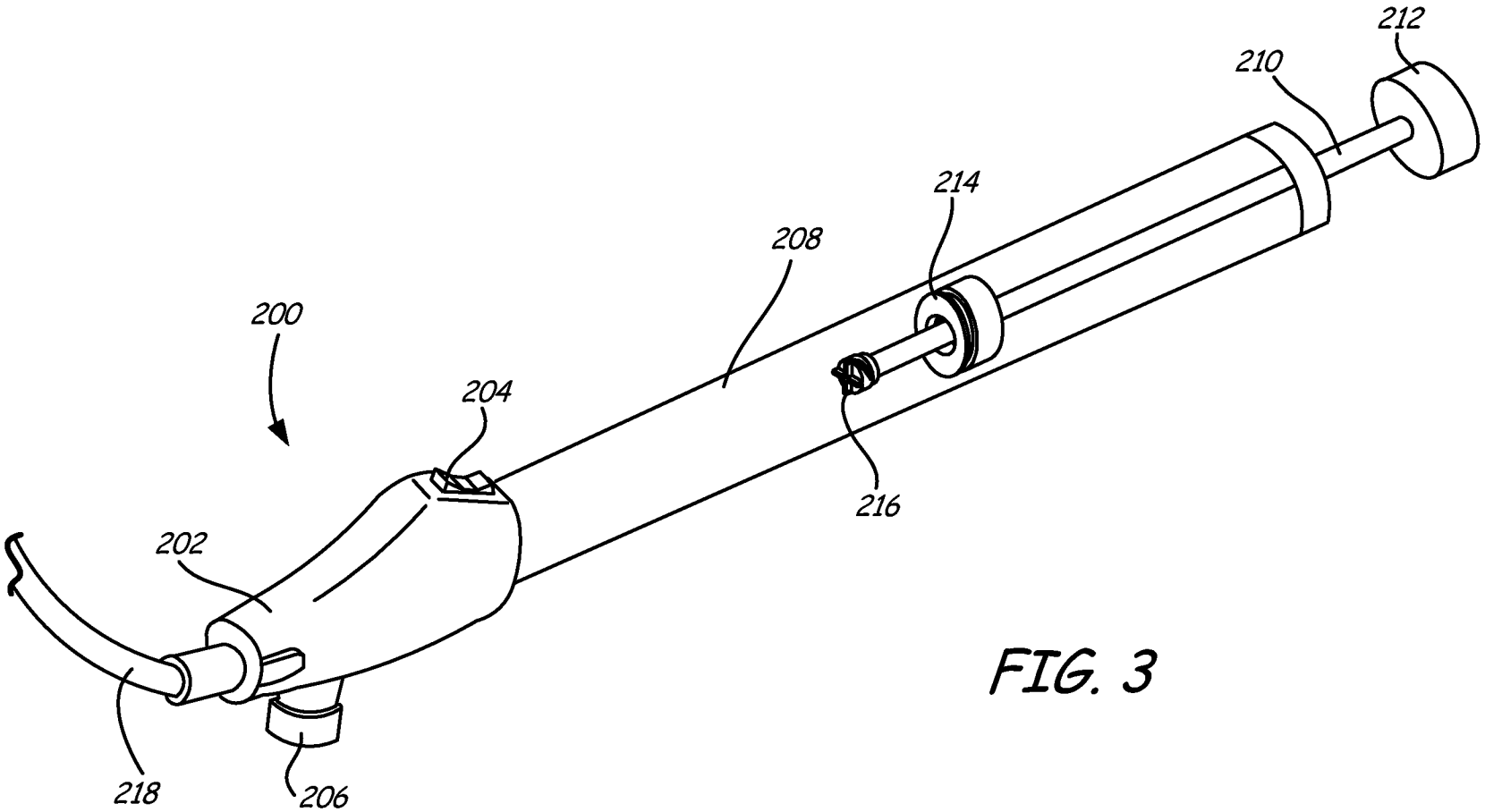
Figure 4:
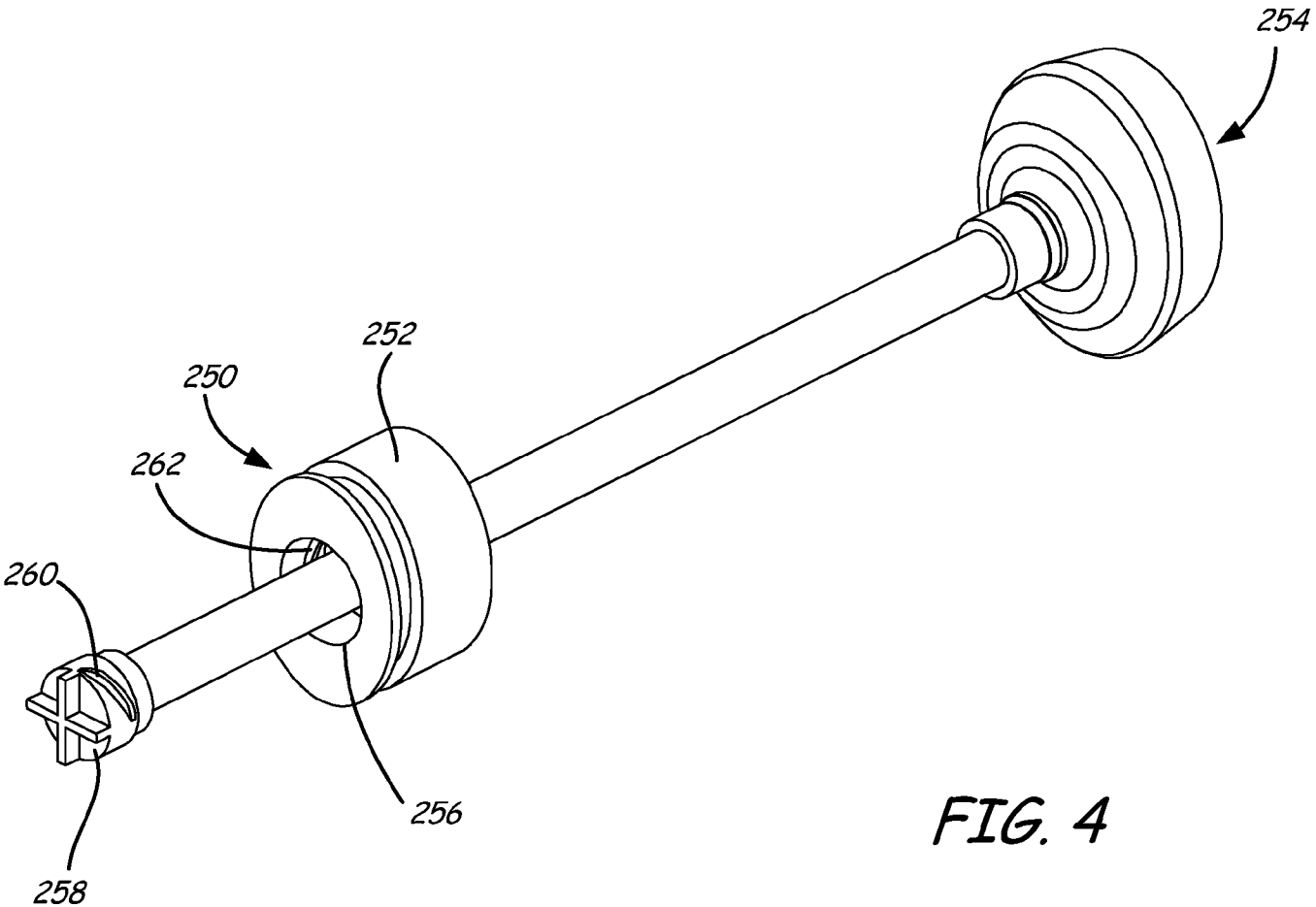

FIG. 2-3 is a perspective view of pump assembly 114 with trigger 118 removed for illustration. FIG. 2-4 illustrates the removed trigger 118. Joint 119 includes a pair of recesses 111 (only one recess 111 is shown in FIG. 2-3) each configured to receive a corresponding protrusion 113 on trigger 118. A raised portion 115 is located proximate each recess 111 and operates to retain each protrusion 113 within the corresponding recess 111. A channel 105 is provided for protrusion 113 on each side of joint 119 enabling removable of trigger 118 from assembly 114.

In the operating position illustrated in FIG. 2-1, when trigger 118 is pivoted away from pump assembly 114 toward the position illustrated in FIG. 2-2, a bottom surface of trigger 118 (illustrative one or more ribbed protrusions 109) contact a wall portion 107. Raised portions 115 and wall portion 107 discourage trigger 118 from being moved from the operating position illustrated in FIG. 2-1 to the pump removal position illustrated in FIG. 2-2.

To move trigger 118 to the pump removal position illustrated in FIG. 2-2, a user exerts a threshold force against trigger 118 which causes some degree of deformation of arms 117, and allows ribbed protrusions 109 to move past wall portion 107. To remove trigger 118 from pump assembly 114, a user presses trigger 118 in a downward direction toward pump assembly 114 causing protrusions 113 to travel through channels 105 and disengage from joint 119.

FIG. 3 illustrates one embodiment of a painting device 200 having an electrically powered pump assembly 202, such as a battery powered pump, operated by a user-actuated control 204 (e.g., on/off switch). Assembly 202 can include any suitable electric motor and pump, such as but not limited to, piston pumps, screw pumps, and diaphragm pumps, to name a few. To fill the paint reservoir, a siphon tube is placed in a paint container and connected to a fill port 206. A user manually retracts the plunger assembly 214 within tube 208 by pulling a knob 212 of fill rod 210 which draws paint from the container.

During a painting operation, the user operates the pump assembly 202 using control 204 which drives the paint pump, thereby pumping paint from tube 208 through a roller arm assembly 218 to a roller (not shown in FIG. 3). As the paint is pumped from tube 208, the plunger assembly 214 advances forward in the tube 208 as a result of the decreasing paint volume.

Rather than driving paint from the paint reservoir by creating an increase in positive pressure within the paint reservoir (e.g., applying manual force to the plunger assembly, spring loading the plunger assembly, etc.), a painting device having a paint pump, such as a positive displacement pump, draws paint from the paint reservoir by creating a vacuum. "Vacuum" refers to a partial vacuum or region of low pressure (e.g., less than an ambient pressure). Suction is created due to the pressure gradient, which draws paint from the paint reservoir into the paint pump.

In accordance with one embodiment, the plunger assembly is movably positioned on the fill rod allowing the rod to be tucked or pushed back into the tube after filling the reservoir, which reduces the overall length of the painting device during use. Conversely, in a painting device in which the plunger assembly is fixed to the plunger rod, the overall length of the painting device is essentially doubled when the paint reservoir is completely filled. That is, the overall length of the painting device increased by the rod length when the rod is pulled to fill the paint reservoir. This increase in length can make it difficult for a user to operate the painting device, especially in small areas such as hallways of a building.

With respect to the embodiment illustrated in FIG. 3 the plunger assembly 214 is movably positioned on fill rod 210, which includes a second knob 216 that engages plunger assembly 214 when fill rod 210 is pulled by a user to manually retract the plunger assembly 214. Then, after the tube 208 is filled with paint, the user pushes the fill rod 210 back into tube 208 while the plunger assembly 214 remains in the retracted position. Fill rod 210 and plunger assembly 214 can be utilized with either powered or non-powered pump assemblies.

FIG. 4 illustrates one embodiment of a plunger assembly 250 having a plunger 252 positioned on a tuck-in rod 254. Plunger 252 includes a through bore 256 having an opening configured to receive a knob 258 of rod 254. Plunger 252 includes at least one locking feature configured to selectively secure plunger 252 on knob 258. The locking feature can include, but is not limited to, threaded and bayonet connections, to name a few. In the illustrated embodiment, the locking feature comprises a quarter turn connection mechanism having one or more helical protrusions 260 disposed on knob 258 and at least one recess 262 along bore 256 configured to receive the one or more protrusions 260. Rod 254 is rotatable between a first, locked position in which plunger 252 is secured to rod 254 and a second, unlocked position in which plunger 252 is movable along rod 254. In one embodiment, plunger 252 and the interior surfaces of the tube in which plunger 252 is positioned have corresponding non-circular shapes, such as an elliptical or oval shape, which prevents plunger 252 from rotating within the tube as the user rotates rod 254 to lock and unlock the plunger assembly 250.

Figure 5:
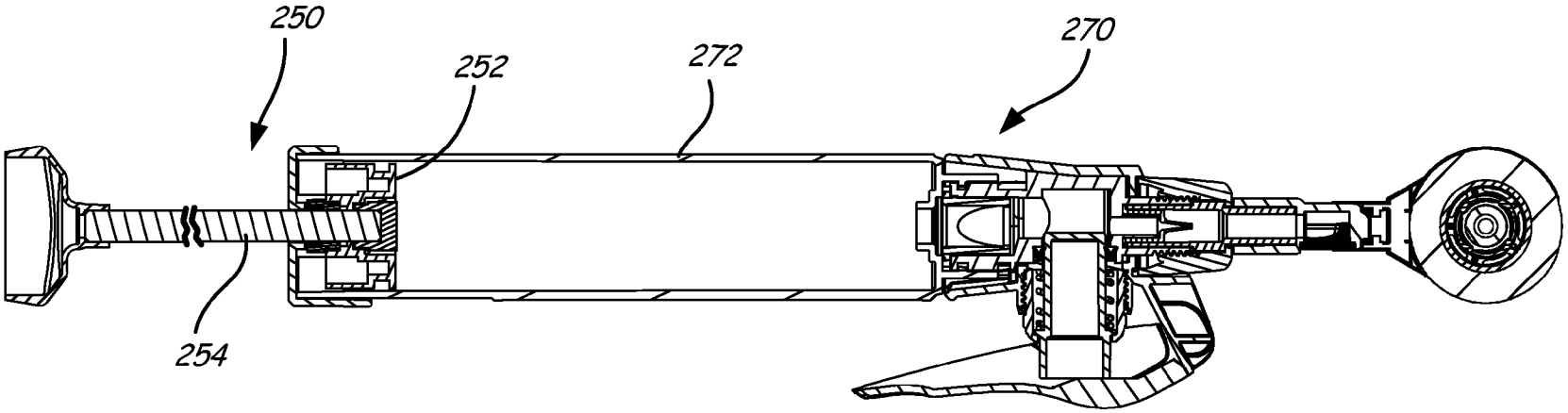
FIGS. 5 and 6 are cross-sectional views illustrating the tuck-in plunger rod of FIG. 4.
Figure 6:
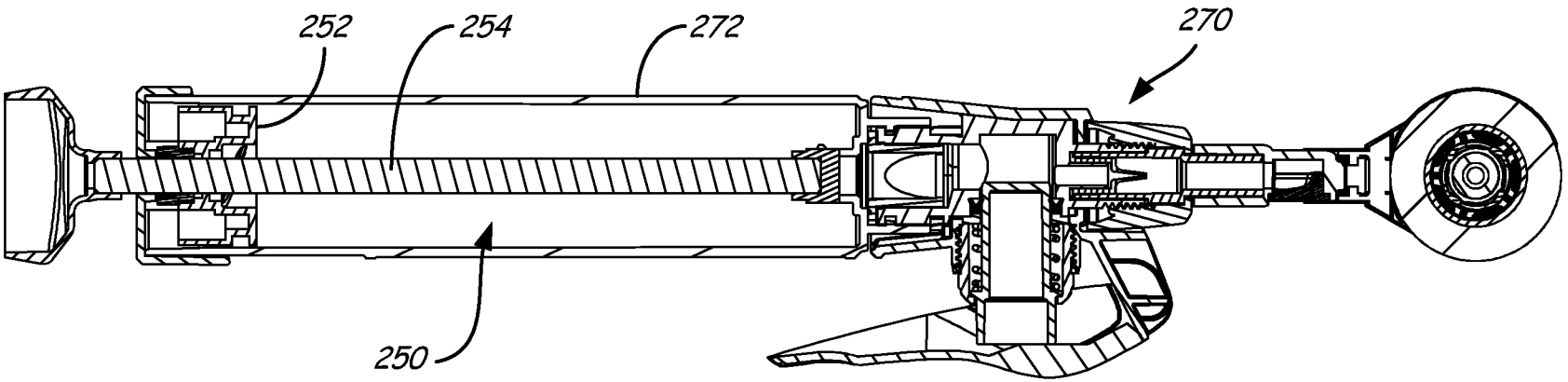

FIGS. 5 and 6 illustrate plunger assembly 250 with an exemplary painting device 270. In FIG. 5, plunger assembly 250 is in the first, locked position in which plunger 252 is secured to rod 254 and retracted within tube 272. In FIG. 6, the user has rotated rod 254 to the second, unlocked position and rod 254 is in a tucked-in state. That is, rod 254 has been pushed back into tube 272 with plunger 252 remaining in the retracted state.

Figure 7:
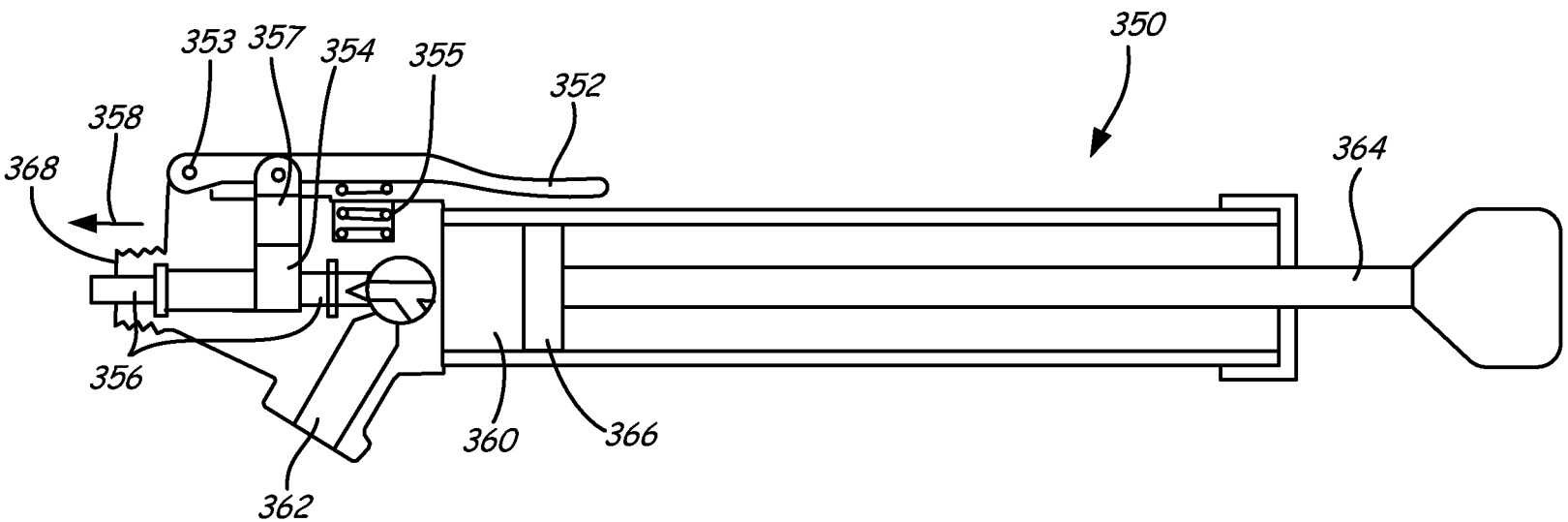
FIG. 7 is a cross-sectional view of a painting device having a paint pump, under one embodiment.

FIG. 7 illustrates another embodiment of a painting device 350 having a manually operated paint pump between a paint reservoir and a paint applicator. Device 350 includes a spring-loaded handle or trigger 352 configured to manually actuate a pump 354. Trigger 352 is mounted on a hinge 353 and is biased by a spring 355. Trigger 352 is attached to a piston or plunger 357 of the pump 354. Valves 356 are configured to allow paint flow to a paint applicator, such as a roller assembly mounted on a connector 368, in a first direction illustrated by arrow 358 and restrict paint flow in a second, opposite direction. A paint reservoir 360 is filled through a fill port 362 by pulling handle 364 which retracts a plunger 366.

In one embodiment, a paint reservoir from which the paint pump draws a supply of paint comprises an on-board reservoir. The on-board paint reservoir is self contained on the portable, handheld painting device, such as the internal reservoirs described above with respect to devices 100, 300, and 350. In another embodiment, the paint reservoir can be external to and/or remotely located from the painting device. For example, a suction or siphon tube having a length of several feet or more can be provided from a remote paint reservoir. Examples of a remote paint reservoir include, but are not limited to, a paint can placed on a floor or carried by the user, such in the user's hand or attached to the user's belt. In one example, a paint container can be formed within a backpack.

Figure 8:
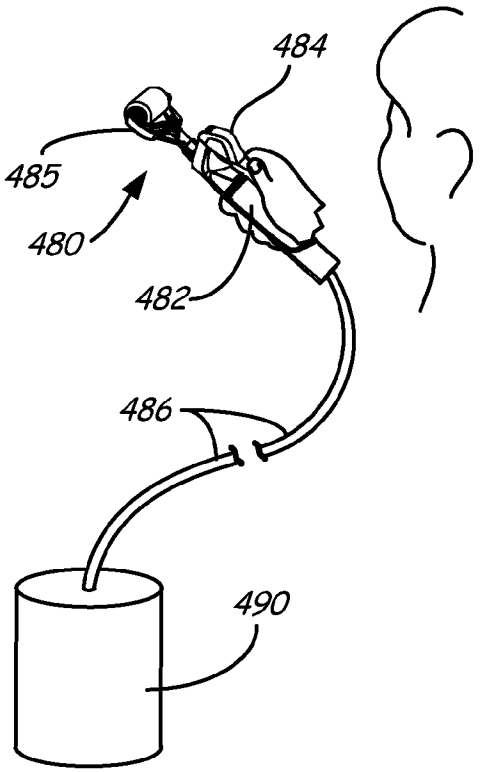
FIG. 8 illustrates a painting device having a paint pump configured to receive paint from a remote paint container, under one embodiment.

FIG. 8 illustrates one embodiment of a portable, handheld painting device 480 having a handle 482, a trigger 484 for actuating a paint pump, and an applicator assembly 486. A remote suction or siphon tube 488 provides a fluid path from a paint reservoir in the form of a paint container 490 (e.g., a conventional one gallon paint can, a five gallon bucket, etc.) to the painting device 480. The paint reservoir is separate from and external to painting device 480. In the illustrated embodiment tube 488 is attached to an end of handle 482 which provides a path for the paint to the paint pump.

Figure 9:
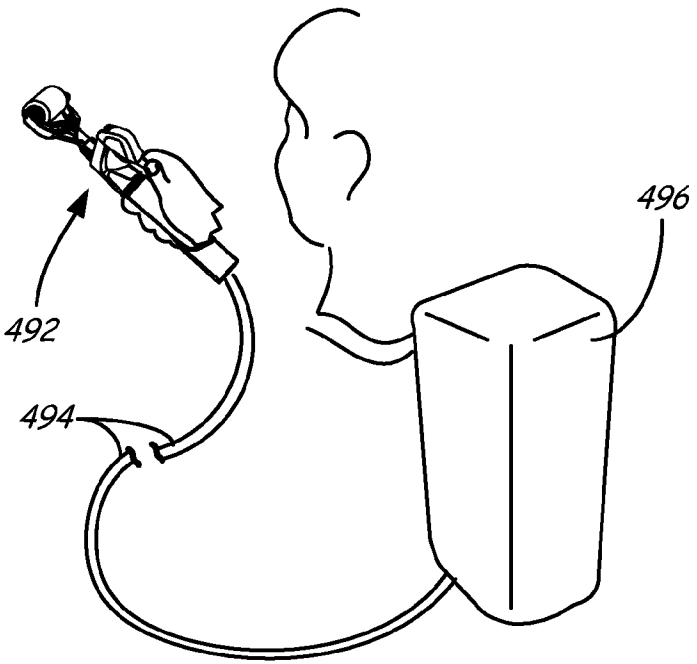
FIG. 9 illustrates a painting device having a paint pump configured to receive paint from a remote paint container, under one embodiment.

FIG. 9 illustrates a portable, handheld painting device 492 that is illustratively similar to device 480. A remote suction or siphon tube 494 provides a fluid path from a paint reservoir in the form of a paint container carried by the user. In the illustrated embodiment, the paint container is formed within a backpack 496 worn by the user.

Figure 10:
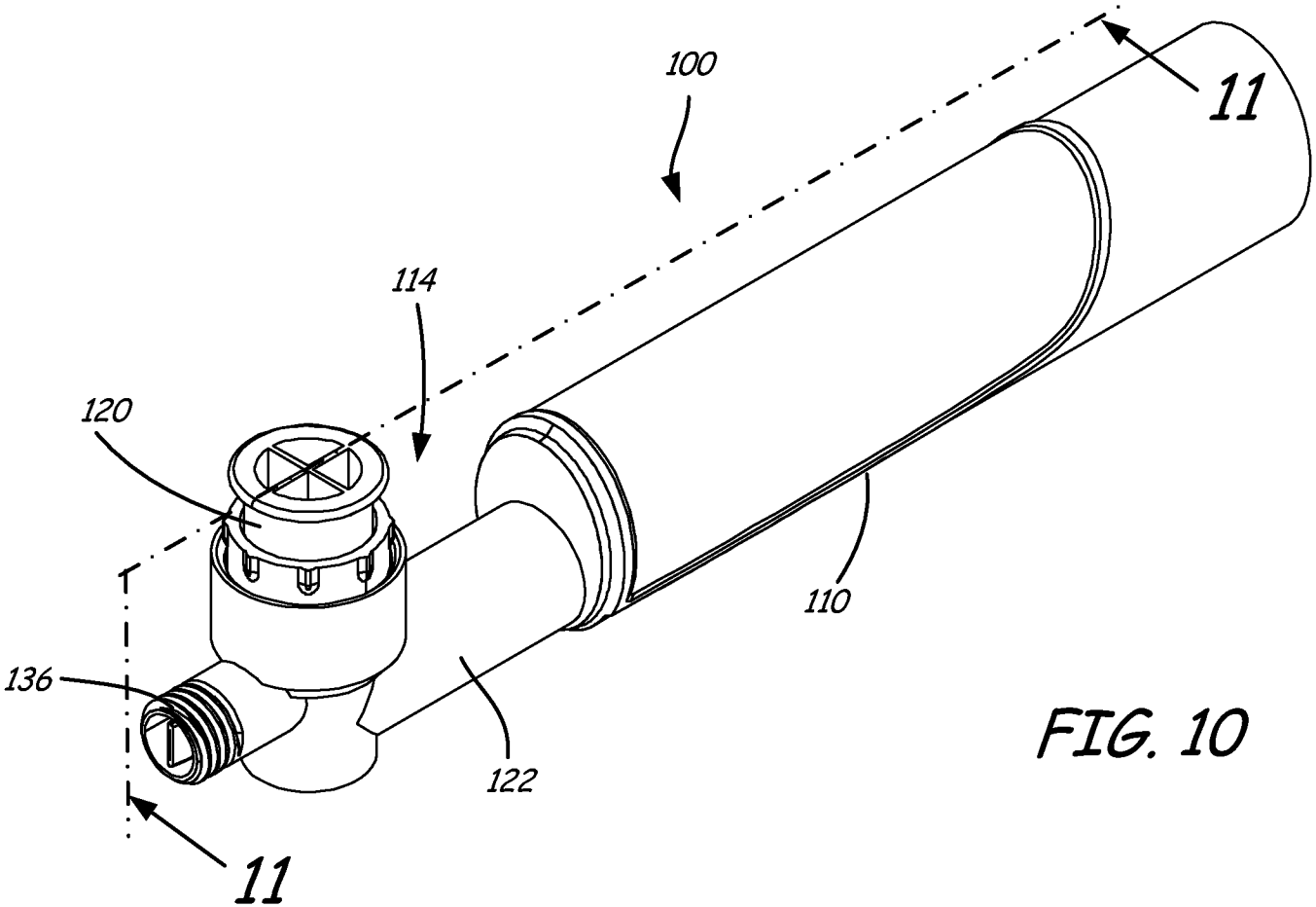
FIGS. 10-12 are views of the device shown in FIG. 1 with portions omitted for illustration purposes.
Figure 11:
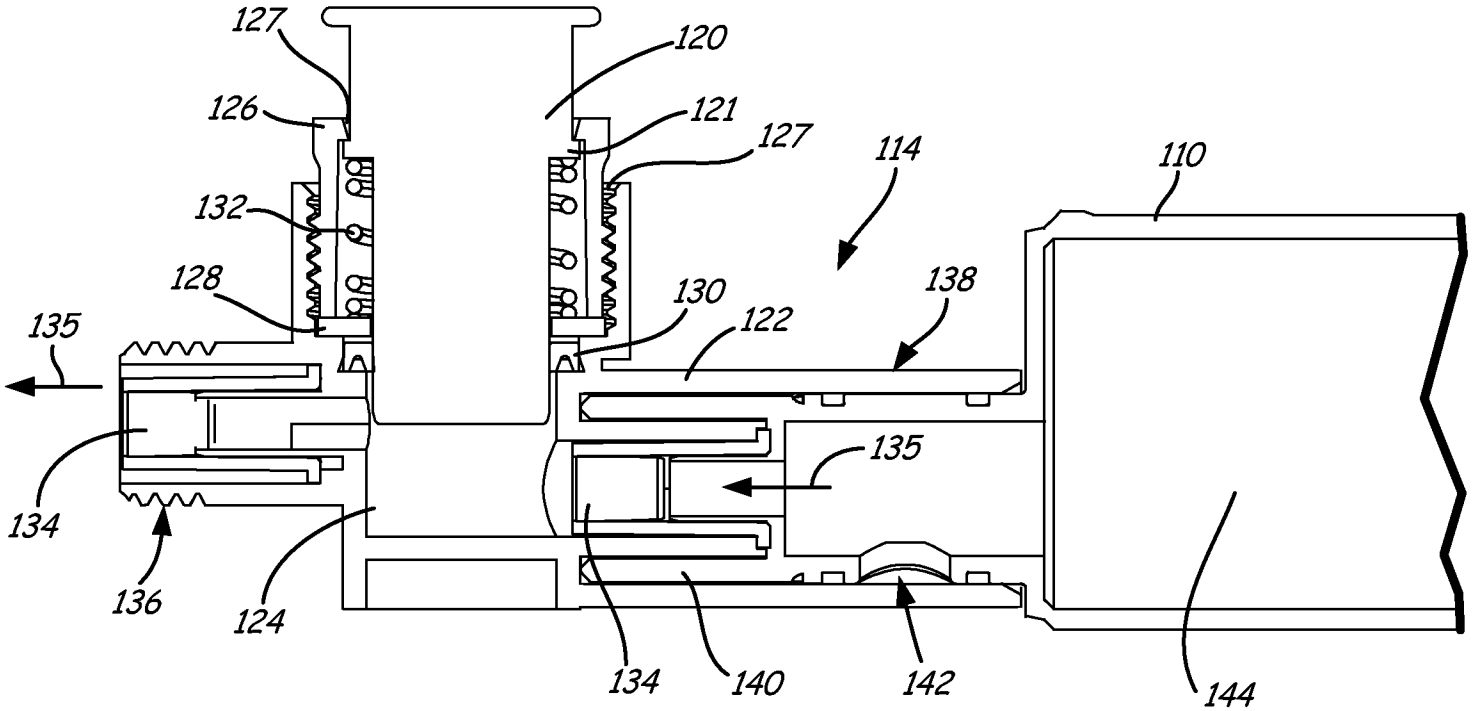
Figure 12:
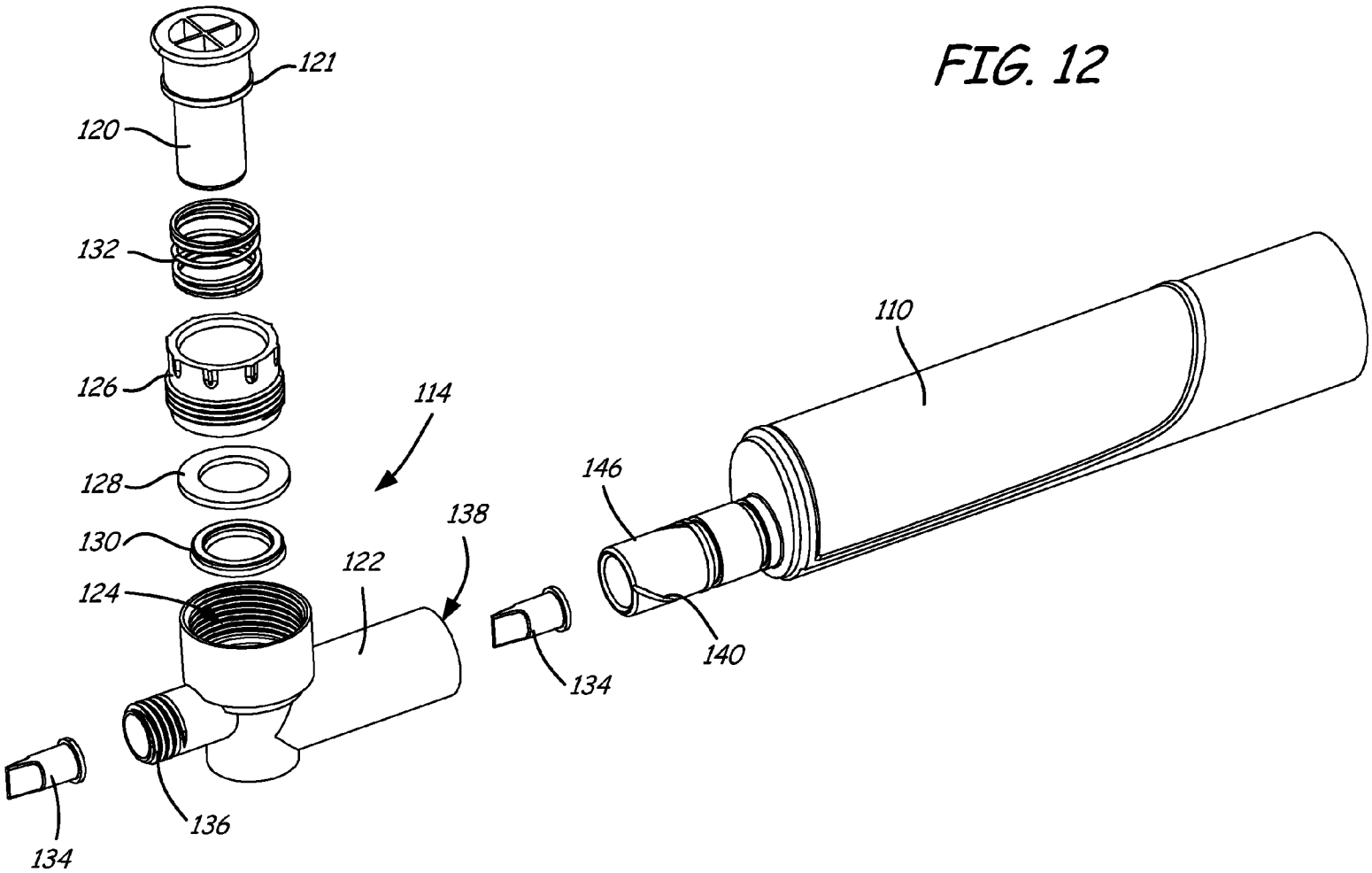

Referring again to device 100, FIG. 10 is a perspective view of the device 100 in which roller arm assembly 108 and the outer casing 116 and trigger 118 of pump assembly 114 have been omitted for illustration purposes. FIG. 11 is a cross-sectional view of device 100 taken at line 11-11 shown in FIG. 10. FIG. 12 is an exploded view of FIG. 10.

Housing 122 includes a first connector 136 for receiving roller arm assembly 108 and a second connector 138 for receiving a connector 140 of tube 110. Assembly 114 is fluidically coupled to tube 110 and includes a manually actuated plunger 120 movable within a pump housing 122. A portion of plunger 120 is positioned within a bore 124 of housing 122. A collar 126 is threadably engaged within a receptacle 127 of housing 122 and includes a mechanical stop, in the form of an annular lip or ridge 127, configured to engage a corresponding structure 121 of plunger 120 and retain plunger 120 within the bore 124. A washer 128 and seal 130 are also provided.

Components of pump assembly 114 are removable from housing 122 by pivoting the trigger 118 away from pump assembly 114, as illustrated in FIG. 2-2. Collar 126 is unthreaded from receptacle 127 allowing plunger 120, washer 128, seal 130, and spring 132 to be removed from housing 122, for example to facilitate cleaning of the pump assembly 114.

Plunger 120 is movable between a first non-actuated position (illustrated in FIG. 11) and a second actuated or depressed position by the user pressing trigger 118 to pump paint in bore 124 to the roller arm assembly 108. Spring 132 biases the plunger 120 to the non-actuated position which creates suction that draws an additional portion of paint from tube 110, which is then pumped during a subsequent actuation of plunger 120. Valves 134 (such as, but not limited to, duckbill valves) are provided and configured to allow paint flow in a first direction (illustrated by arrows 135) through assembly 108 and restrict paint flow in a second, opposite direction.

Connector 140 of tube 110 includes a fill port 142 (illustrated in FIG. 11) for filling the internal reservoir 144 of tube 110. In one embodiment, connectors 138 and 140 are threadably engaged such that rotation of tube 110 with respect to assembly 108 exposes fill port 142. By way of example, an interior surface of connector 138 includes a helical ridge configured to engage a groove 146. Mechanical stops can be provided to prevent connector 140 from being entirely removed from connector 138, thereby maintaining a sealing engagement between connectors 138 and 140 and preventing paint from being spilled.

Figure 13:
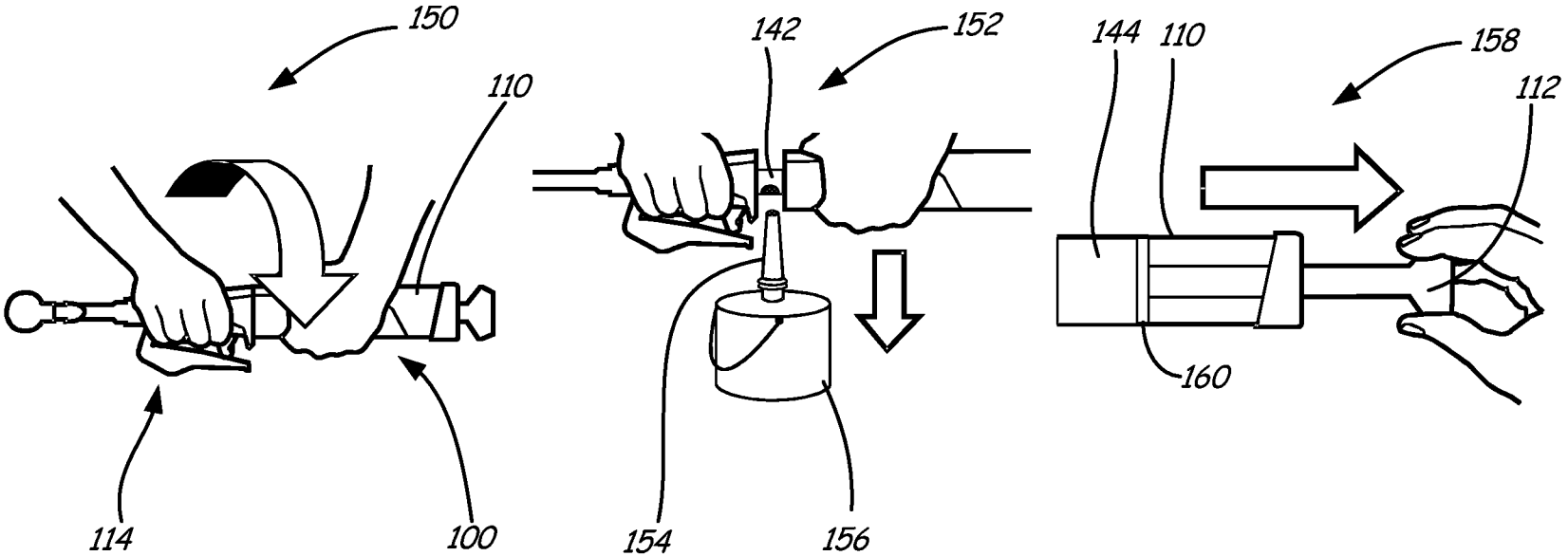
FIG. 13 illustrates an exemplary fill port and process for filling a painting device.

FIG. 13 illustrates an exemplary process for filling device 100. At block 150, a user grasps device 100 and rotates tube 110 with respect to assembly 114. This rotation moves tube 110 away from assembly 114 exposing port 142, as shown at block 152. A dip or siphon tube 154 is inserted into port 142 and placed in a paint container 156. As shown in block 158, a user pulls knob 112 retracting plunger 162 within tube 110 which draws paint into the reservoir 144.

Figure 14:
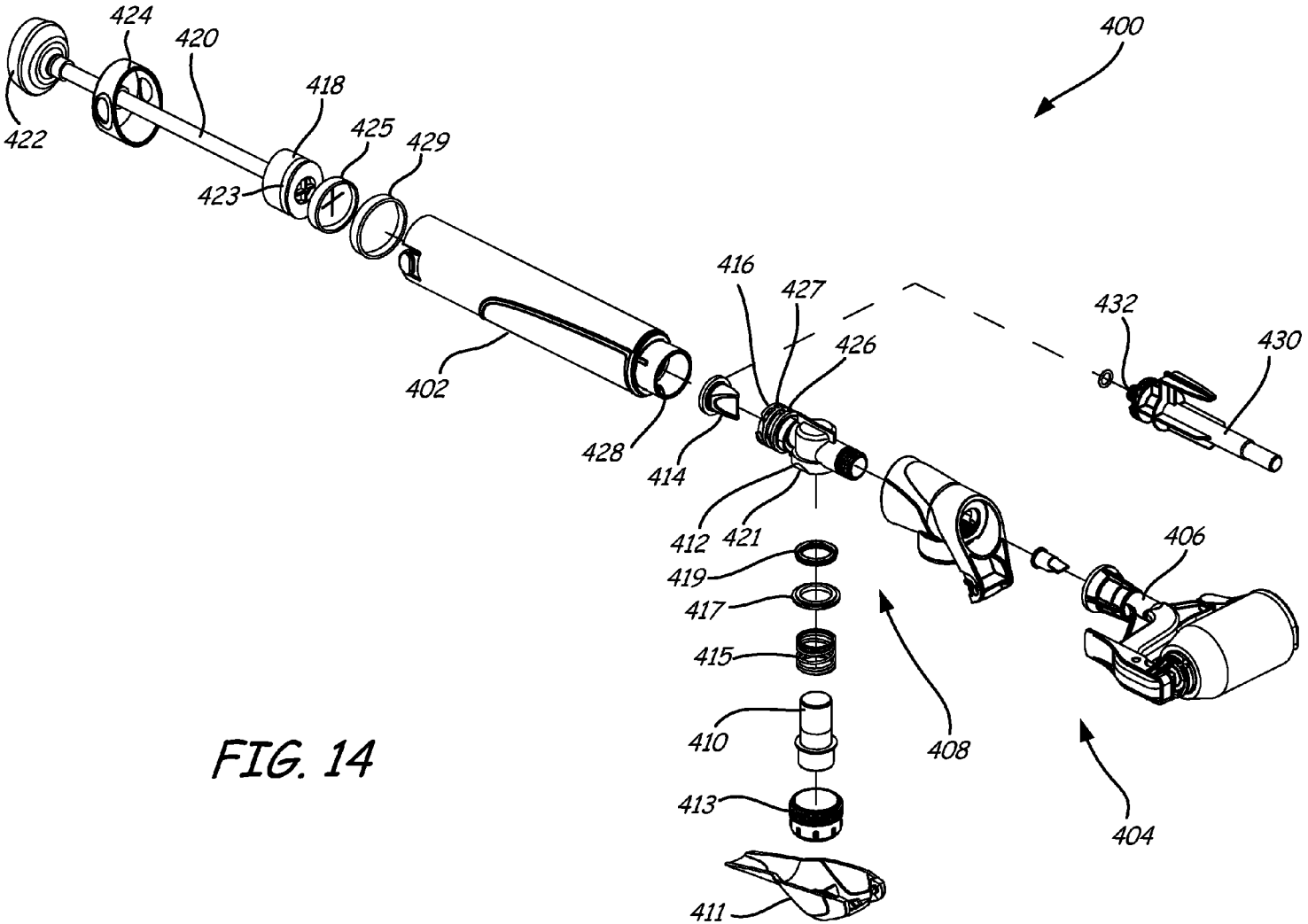
FIG. 14 is an exploded perspective view of a painting device having a fill port, under one embodiment.

FIG. 14 illustrates another embodiment of a painting device 400 having a fill port for filling an internal paint reservoir. FIG. 14 is an exploded perspective view of device 400, which includes a tube 402 forming the paint reservoir, and a pump assembly 408 that is removably coupled to tube 402 and delivers paint to a paint applicator assembly or head 404. Assembly 404 includes a roller arm 406 attached to pump assembly 408. Pump assembly 408 includes a plunger 410 movably positioned within a pump assembly housing 412. A trigger 411 is operable to actuate plunger 410. Pump assembly 408 illustratively includes a threaded collar 413 that mates within a threaded receptacle 421 to retain plunger 410 in housing 412. A spring 415 biases plunger 410 away from housing 412. A washer 417 and seal 419 are provided to prevent fluid from leaking past plunger 410 and into collar 413. In one embodiment, pump assembly 408 and trigger 411 are substantially similar to pump assembly 114 and trigger 118 illustrated above with respect to FIG. 1.

Assembly 408 is removably coupled to tube 402 using connectors 426 and 428 on housing 412 and tube 402, respectively. In one embodiment, assembly 408 is removably coupled to tube 402 using a threaded connection. In one embodiment, assembly 408 is removably coupled to tube 402 using a quarter turn bayonet connection. An o-ring 427 is provided to reduce or inhibit paint leakage between connectors 426 and 428.

A valve 414 (illustratively a duckbill valve) is positioned within an inlet 416 of housing 412. A plunger 418 is mounted on a first end of a plunger rod 420. A second end of rod 420 includes a knob 422 for a user to grasp when retracting plunger rod 420. A cap 424 is attached to tube 402 and has a through hole or aperture receiving rod 420. An o-ring 423 can be provided to reduce or inhibit paint leakage past plunger 418.

To fill the paint reservoir within tube 402, a user removes assembly 408, including valve 414, from tube 402. Then, a fill nozzle 430 is attached to tube 402 using connector 428 and a corresponding connector 432 on nozzle 430. Nozzle 430 is placed in a paint container and plunger rod 420 is retracted drawing paint through nozzle 430 into tube 402. Nozzle 430 is removed and applicator assembly 404 is placed back on tube 402. In one embodiment, a two-way valve 425 is provided within tube 402 proximate the end having connector 428. Valve 425 is configured to allow paint flow in either direction, but provides some level of flow resistance to discourage paint from running out of tube 402 during the filling process, for example after nozzle 430 has been removed. Valve 425 can be any suitable type of valve such as, but not limited to, a star valve. Valve 425 is illustratively positioned within a washer 429 and can be retained within tube 402 using any suitable fastening configuration.

Figure 15:
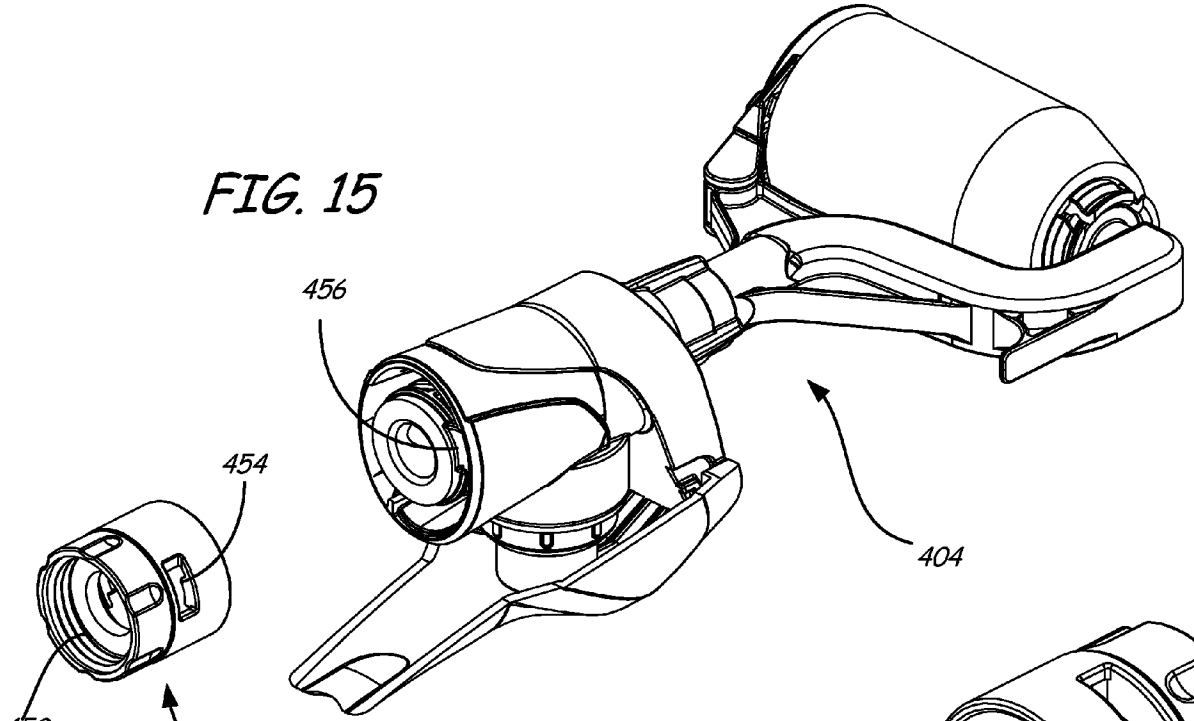
FIGS. 15 and 16 are perspective views of an adapter for cleaning the painting device illustrated in FIG. 14, under one embodiment.
Figure 16:
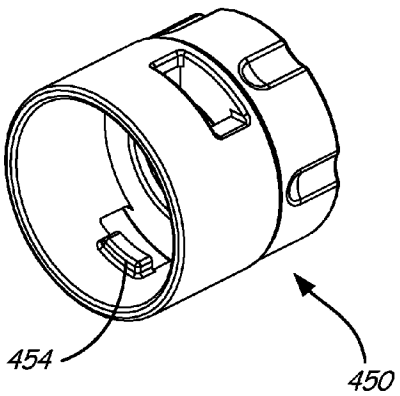

Assembly 404 can be separately cleaned, for example by connecting a source of solvent to assembly 404. In one example illustrated in FIGS. 15 and 16, an adapter 450 can be provided for connecting a conventional garden hose to assembly 404. Adapter 450 includes a first threaded connection 452 for receiving the garden hose and a second connection 454, illustratively a protrusion, for engaging a recessed slot 456 of assembly 404. Rotation of adapter 450 secures adapter 450 to assembly 404.

Figure 17:
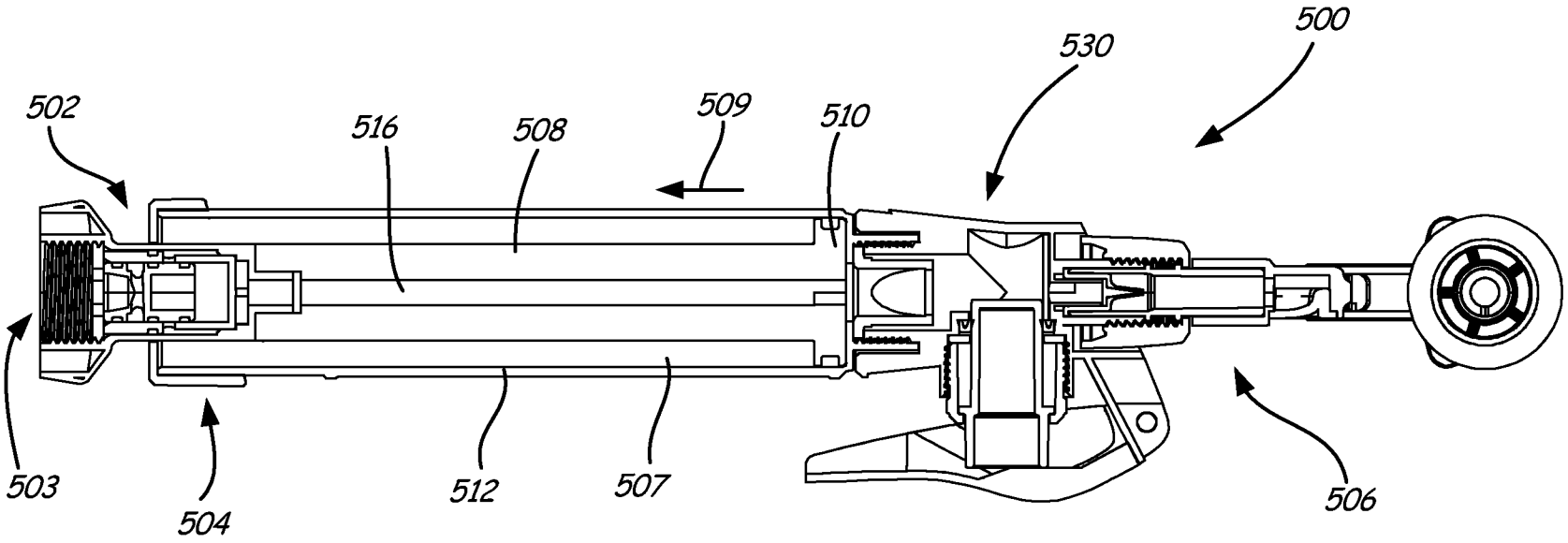
FIG. 17 is a cross-sectional view of a painting device having a fill port, under one embodiment.
Figure 18:
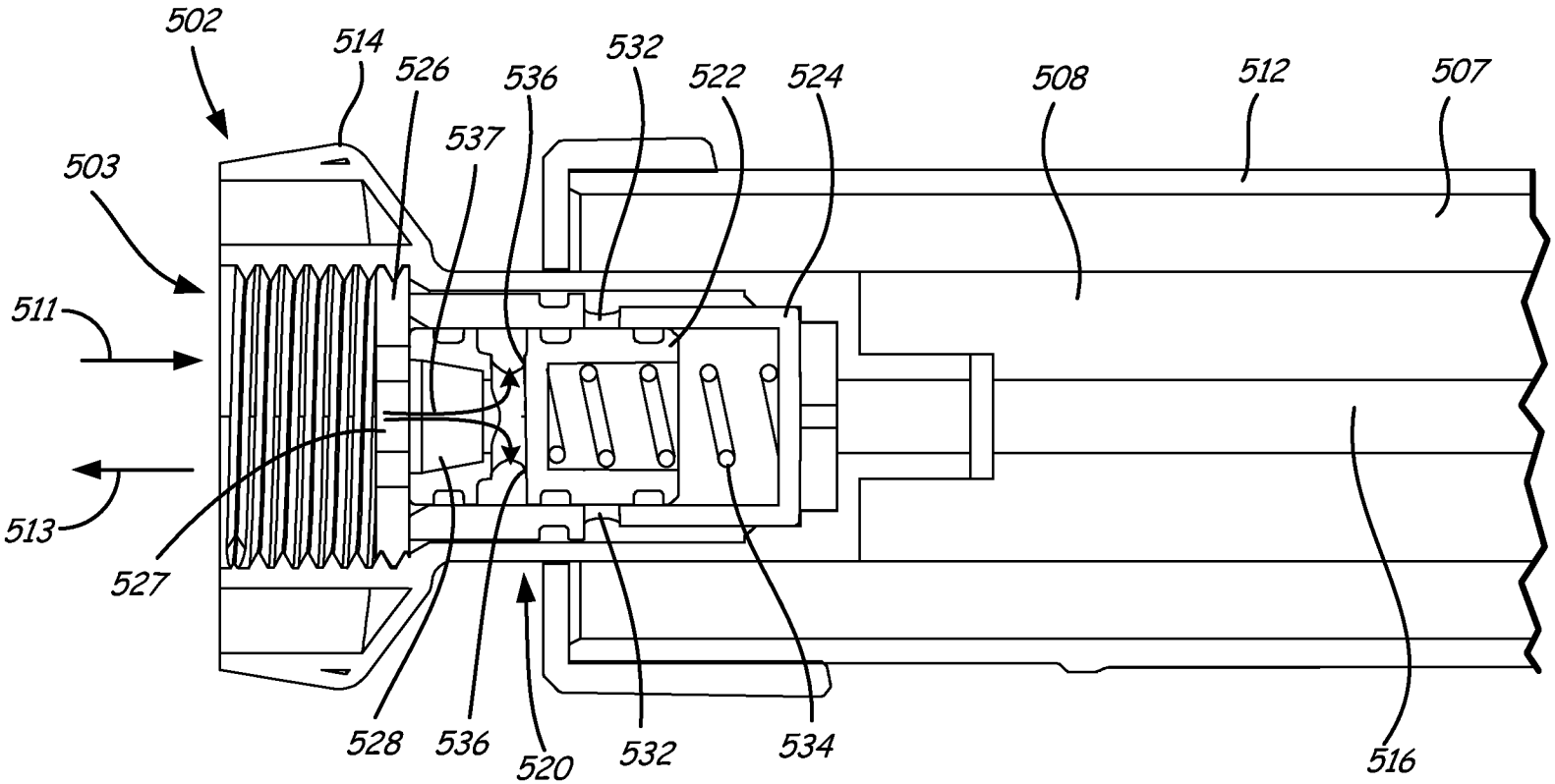
FIGS. 18 and 19 are cross-sectional views of the fill portion illustrated in FIG. 17.
Figure 19:
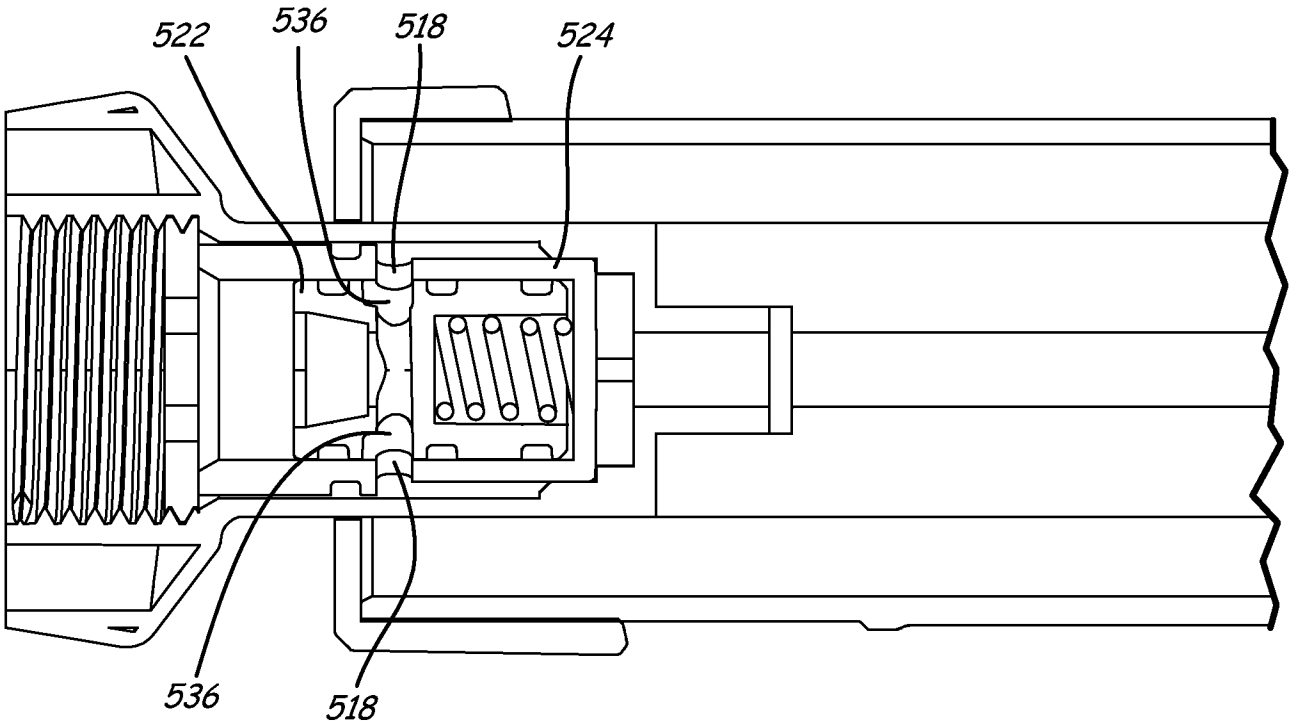

FIGS. 17-19 illustrate another embodiment of a fill port for a painting device. FIG. 17 is a cross-sectional view of an exemplary painting device 500 having a fill port assembly 502 at an end 504 and a pump assembly 530. FIGS. 18 and 19 are enlarged views of fill port assembly 502.

End 504 of device 500 is illustratively opposite a roller assembly end 506. Fill port assembly 502 has an opening 503 for receiving a flow of paint, such as from a siphon tube, for filling a reservoir 507 formed within a tube 512. Assembly 502 is mounted on a plunger rod or shaft 508 using any suitable connection mechanism(s) and is fluidically coupled to a bore 516 formed through rod 508 and a plunger 510. Plunger 510 is mounted to an end of rod 508 and is movable within tube 512. In other embodiments, fill port assembly 502 can be located at other positions along tube 512.

When painting device 500 is being filled through opening 503, a fluid path is provided from opening 503 to plunger 510, through assembly 502 and bore 516. As plunger 510 is retracted within tube 512 (in a direction represented by arrow 509) using rod 508 to expand the reservoir, paint is drawn from opening 503 through assembly 502 and bore 516.

As illustrated in FIG. 18, assembly 502 includes a body 514 that is attached to rod 508 and forms a knob for a user to grasp when retracting the plunger 510. Assembly 502 includes a valve positioned within body 514 along the fluid path through fill port assembly 502. The valve is configured to allow paint flow through fill port assembly 502 in a first direction (generally illustrated by arrow 511) to fill reservoir 507 and restrict paint flow in a second, opposite direction (generally illustrated by arrow 513) to prevent paint from leaking out of reservoir 507 through fill port assembly 502.

The valve of fill port assembly 502 is also configured to discourage or prevent the vacuum or suction within reservoir 502, created by the pump, from inadvertently opening the valve which could result in air being drawn into reservoir 502. By way of example, the valve of device 500 comprises spool valve assembly 520 positioned within body 514 along the fluid flow path through fill port assembly 502. A nut 526 is threadably engaged to body 514 and retains the spool valve assembly 520 within body 514. Nut 526 includes an opening 527 (also shown in FIG. 20) allowing fluid flow from opening 503.

Spool valve assembly 520 including a movable spool member 522 positioned within a housing 524. Member 522 is movable between first and second positions to control paint flow through spool valve assembly 520. Member 522 includes an inlet 528 receiving paint and a paint flow path (generally represented by arrows 537) to one or more outlet openings 536.

In the first, closed position (shown in FIG. 18), the interface between surfaces of spool member 522 and housing 524 restrict fluid flow through spool valve assembly 520. In a second, open position (shown in FIG. 19), the outlet openings 536 in spool member 522 are aligned with openings 532 (also shown in FIG. 20) of housing 524 to form one or more through ports 518. In this manner, in the second position a paint flow path is formed through spool member 522 and housing 524 to bore 516. A spring 534 is provided for biasing member 522 to the first, closed position. The configuration of valve assembly 520 is such that any forces upon movable spool member 522 as a result of the suction created within tube 507 are in a direction other than a direction of movement (i.e., direction 1411) of member 522 to the second, open position. That is, the configuration of member 522 discourages the suction of the paint pump from inadvertently actuating member 522 to the second, open position. In the illustrated embodiment, any such forces are in a direction that is substantially perpendicular to the direction of movement of member 522.

By way of example, to fill painting device 500 a fluid siphon tube is inserted through opening 503 and engaged to spool member 522. A manual force is applied by the siphon tube to spool member 522 thereby moving the spool member 522 to the second position, which opens ports 518 as shown in FIG. 19. The plunger 510 is then retracted by pulling body 514 which draws fluid from the siphon tube through assembly 520 and bore 516, and into the fluid reservoir 507.

During operation, pump assembly 530 is used to pump paint from the reservoir 507. Partial vacuum pressure generated by the pump assembly 530 action causes suction of the paint from the reservoir 507. Spring 534 maintains the spool member 522 in the first, closed position preventing the suction from drawing air into the fluid reservoir 507 through the spool valve assembly 520.

Figure 20:
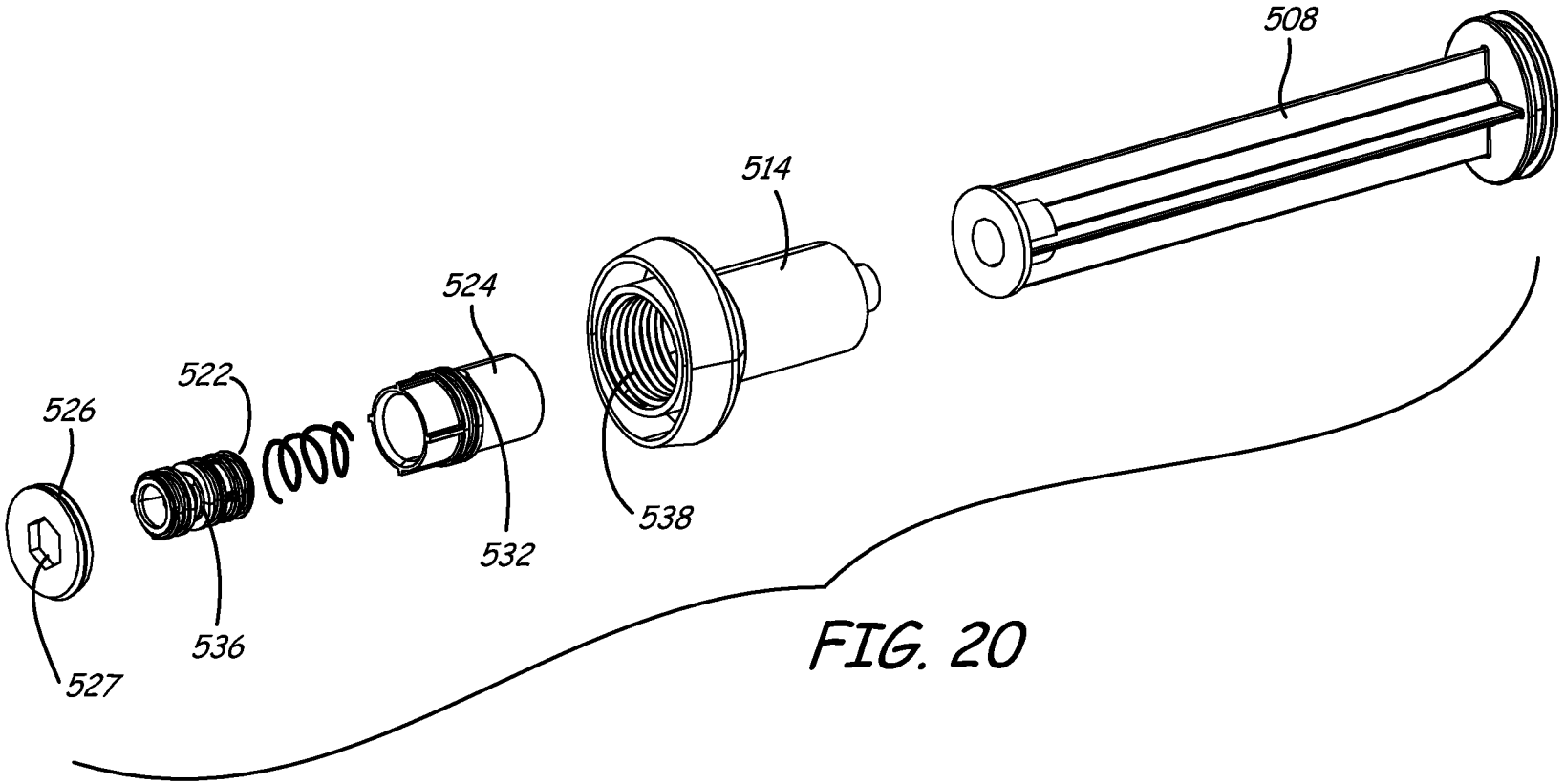
FIG. 20 is an exploded view illustrating the fill port shown in FIG. 17.

FIG. 20 is a perspective view illustrating nut 526, spool member 522, spool valve housing 524, body 514, and rod 508. Body 514 includes thread 538 formed along an inner surface. The threads are configured to receiving corresponding threads formed on nut 526. Additionally, the threads 538 can be used to receiving a conduit or hose, such as, but not limited to, a conventional garden hose, for cleaning the painting device 500. By way of example, the pressure from a flow of water into fill port assembly 502 actuates the spool valve assembly 520 allowing the water to flow through the spool valve assembly 520 and bore 516.

In other embodiments, spool valve assembly 520 can be positioned at other positions along the reservoir. For example, but not by limitation, with respect to device 350 illustrated in FIG. 7 a spool valve assembly can be positioned in fill port 362.

Referring again to FIG. 14, actuating the pump mechanism when the paint reservoir is empty (i.e., when the plunger is not retracted) can cause vacuum pressure to build within the paint reservoir. This vacuum pressure within tube 402 can cause removal of assembly 404 from tube 402 to be difficult (i.e., the user has to overcome the vacuum pressure) and/or cause valve 414 to be removed with tube 402 during disassembly. In accordance with one embodiment, plunger 418 can include a valve engaging feature configured to mechanically engage valve 414 and discourage valve 414 from causing vacuum pressure to build within the paint reservoir.

Figure 21:
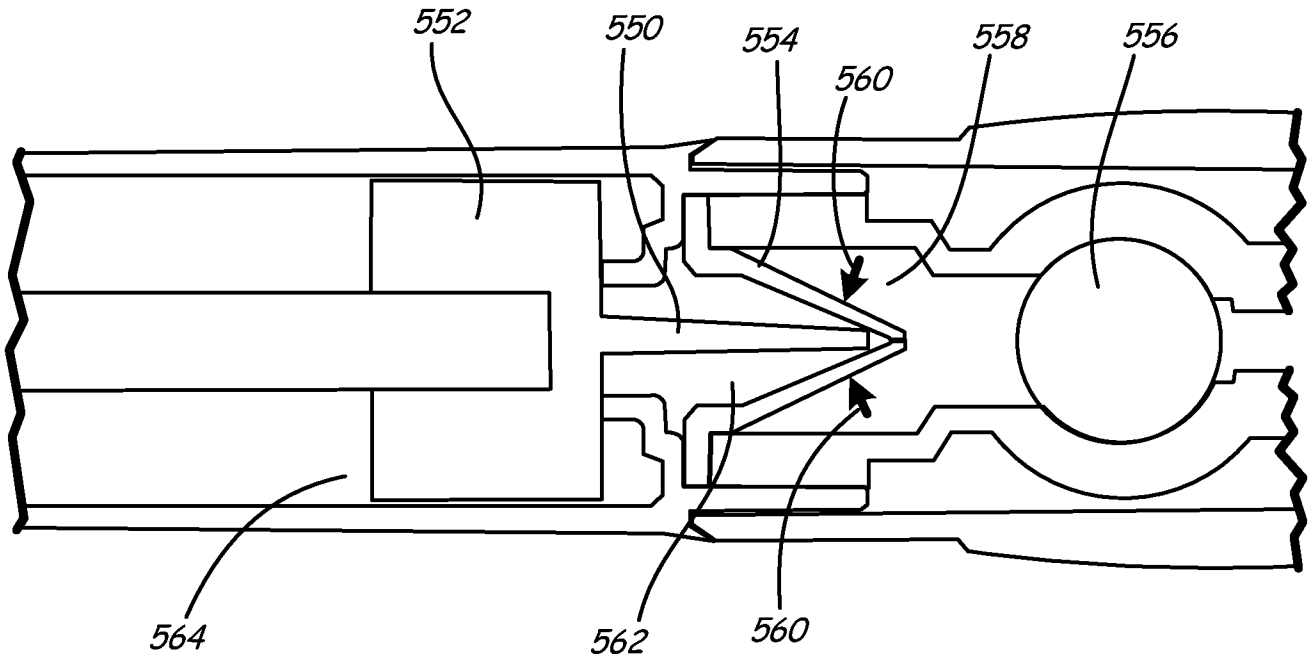
FIG. 21 is a cross-sectional view illustrating a plunger assembly having a valve-engaging feature, under one embodiment.

FIG. 21 is a cross-sectional view of an exemplary painting device having a valve engaging feature 550 extending from plunger 552. Feature 550 is proximate to or in contact with inner surfaces of valve 554, which is illustratively a duckbill valve, when plunger 552 is at the end of reservoir 564 in a fully advanced position. When pump 556 is actuated in this position, a pressure increase in chamber 558 applies a force (generally represented by arrows 560) against portions of valve 554, deforming those portions toward feature 550. Contact between feature 550 and valve 554 causes valve to open to some extent, allowing fluid flow through the valve. This opening of valve 554 discourages or prevents vacuum pressure from building behind valve 554 in a space 562 between valve 554 and the plunger 552 if the user continues to operate the pump 556 when reservoir 564 is empty. In another embodiment, feature 550 is configured to extend through duckbill valve 554 to maintain the valve in an open position.

Figure 22:
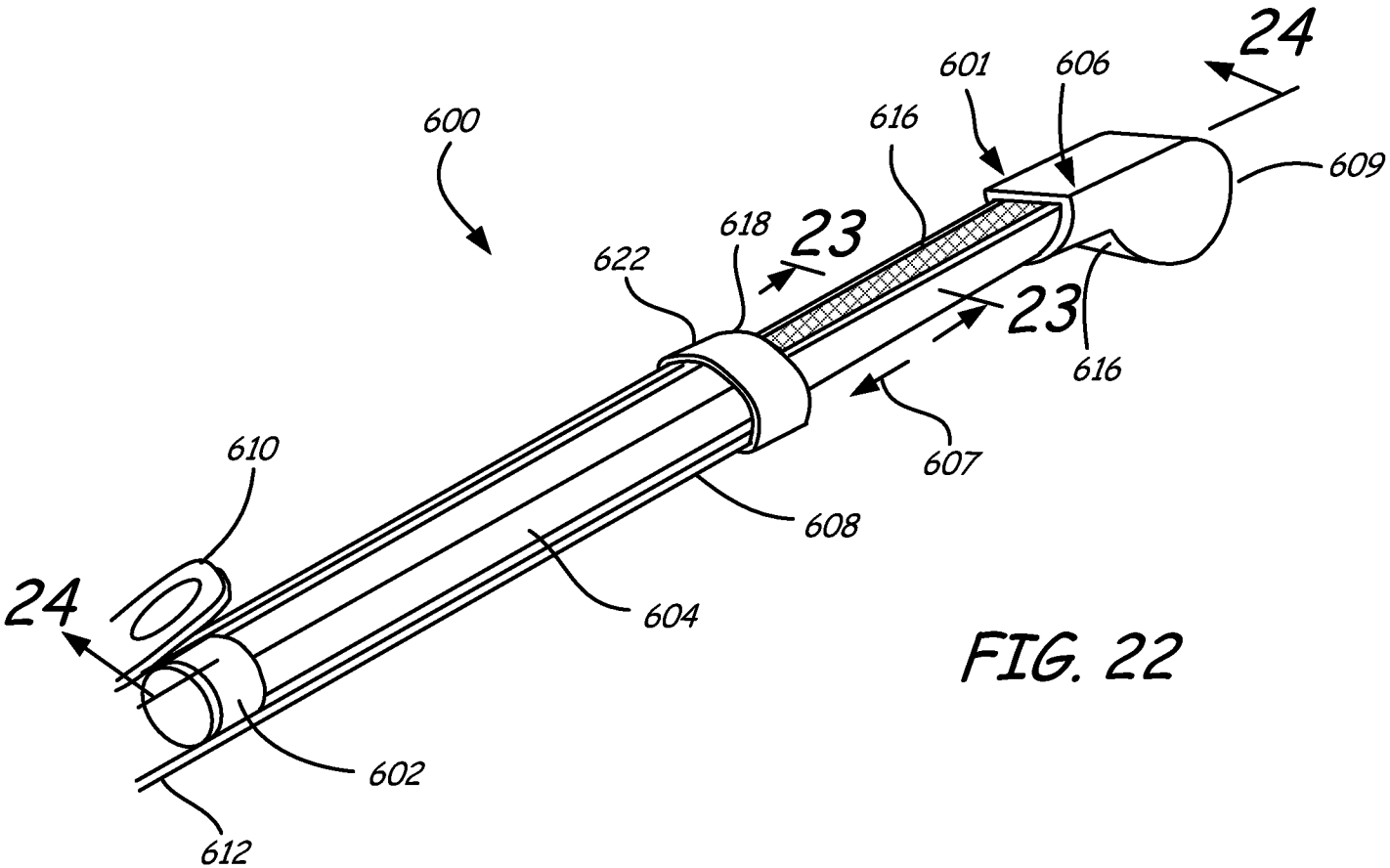
FIG. 22 is a perspective view of a painting device having a constant force drive assembly, under one embodiment.
Figure 24:
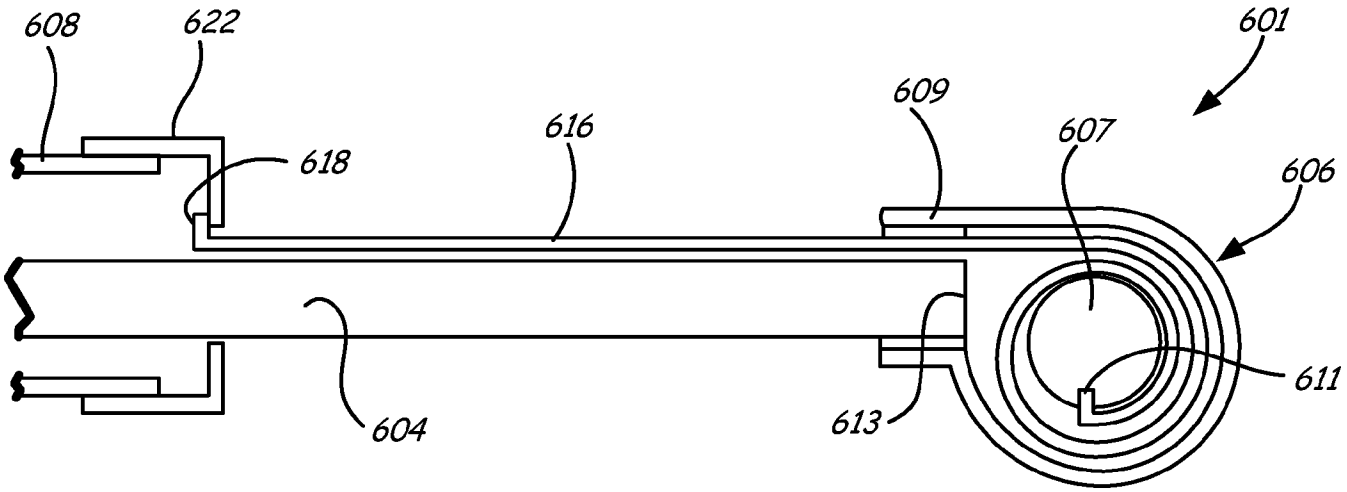
FIGS. 23 and 24 are cross-sectional views of FIG. 22.
Figure 23:
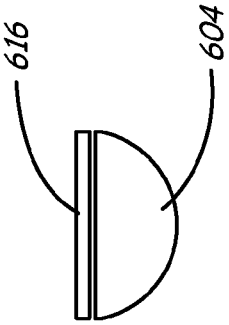

Alternatively, or in addition, to use of a fluid pump, a drive mechanism can be utilized to apply forward force on the plunger assembly to create positive pressure within the paint reservoir and drive paint to the paint application. In accordance with one embodiment illustrated in FIG. 22, a drive mechanism 601 is configured to apply a forward force on a plunger assembly 602. As illustrated, plunger assembly 602 is mounted on a first end of a shaft or rod 604 and is movable within tube 608, which is illustratively transparent and forms a paint reservoir 612. A lever 610 is configured to open a valve to selectively release paint under pressure from the paint reservoir 612. FIGS. 23 and 24 are cross sectional views taken at lines 23 and 24, respectively, illustrated in FIG. 22.

Mechanism 601 includes a constant-force spring assembly 606 that is mounted at a second end of rod 604, and is configured to exert a substantially constant force on rod 604 in direction 607 over a range of motion of plunger assembly 602. Spring assembly 606 illustratively comprises a power or clock spring, and includes a rolled ribbon of material 616 such as a spiral strip or ribbon of spring steel or other suitable material. A first end of material 616 is attached to an anchor 618 at a lock ring 622 and a second end of material 616 is on a spool 607 within a spool housing 609. Spool 607 can be rotatably mounted within housing 609 or can be fixedly attached to housing 609. The second end of material 616 can be freely positioned on spool 607 or can be secured to spool 607 using a second anchor 611. Housing 609 is attached to an end 613 of rod 604.

In one embodiment, material 616 has a substantially flat cross section. In another embodiment, material 616 can have a slightly concave shape and, when rolled up on spool 607, is deformed to a substantially flat cross-section.

As material 616 is unrolled from spool 607, the spiral ribbon on the spool 607 is contracted deforming the material to some extent. A restoring force urges the ribbon on spool 607 to return to an expanded spiral shape. This restoring force urges the unrolled portion of material back onto the spool 607 and is substantially constant as the material is unrolled. By substantially constant, it is understood that the resultant restoring force may not be exactly constant, but can include some small variation accounting for material or design tolerances, for example.

In one embodiment, assembly 606 is configured to apply a force that is within a small percent of deviation (i.e., less than 1%, 2%, 5%, 10%, etc.) from a target force. In one particular example, assembly 606 applies a force to rod 604 between 14 and 16 pounds. In another particular example, assembly 606 applies a force to rod 604 between 14.5 and 15.5 pounds. In another particular example, assembly 606 applies a force to rod 604 between 14.8 and 15.2 pounds.

By way of illustration, use of non-constant force mechanisms, such as compression coil springs, to apply force on a plunger assembly can result in uneven paint flow to the painting applicator as the amount of force applied to the plunger assembly varies based on the plunger assembly position. The force exerted by a compression spring increases the further the spring is compressed. Thus, when the plunger assembly is fully retracted (i.e., the compression spring is fully compressed) the compression spring exerts a greater force on the plunger assembly than when the plunger assembly is less retracted (i.e., the compression spring is less compressed). In contrast to use of mechanisms such as a compression coil spring where the force exerted by the spring is proportional to its change in length, the amount of force exerted on rod 604 by constant-force spring assembly 606 is substantially the same regardless of the position of plunger assembly 602 within tube 608. In this manner, the flow of paint to the paint applicator is substantially constant providing for even application of paint to the surface.

Figure 25:
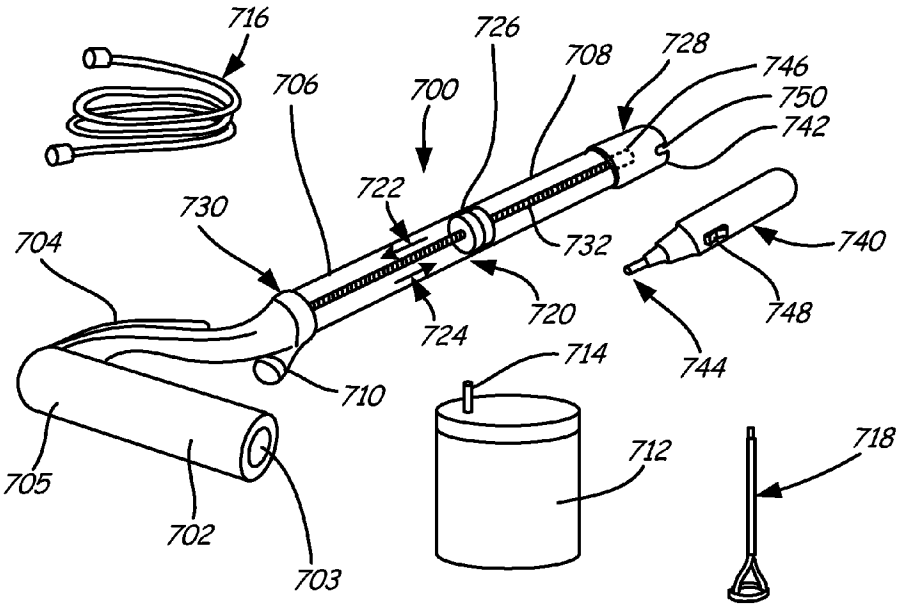
FIG. 25 illustrates a painting device having a powered drive mechanism, under one embodiment.

FIG. 25 illustrates another embodiment of a drive mechanism for a painting device. An exemplary painting device 700 has a paint applicator in the form of a paint roller 702 formed of a suitable material and positioned on a roller core 703 that is rotatably mounted on a roller arm assembly 704. Assembly 704 is connected to a tube 708 that includes a paint reservoir 706. The paint reservoir 706 is filled with paint from a paint container 712 through a fill port 710. Container 712 has a fill port 714 that can be attached directly to port 710. Alternatively, a tube 716 can be used to couple ports 710 and 714. A suction tube assembly 718 can be used within paint container 712 to receive paint from a bottom of paint container 712. Port 710 includes a valve configured to allow the paint to enter port 710 when reservoir 706 is being filled, but prevent paint from exiting the port 710.

Roller cover 702 is internally fed through roller arm assembly 704 and is perforated to allow the paint to pass from the roller core 703 to an applicator surface 705. Device 700 includes a drive mechanism 720 that is selectively activated to supply paint from reservoir 706 through roller arm assembly 704. Drive mechanism 720 includes a plunger assembly 726 that is movable within tube 708 at least partially between a first end 728 and a second end 730 of tube 708. Plunger assembly 726 is moved in a first direction 722 to drive paint in reservoir 706 through roller arm assembly 704 during a painting operation, and in a second direction 724 when filling reservoir 706 through port 710.

Figure 26:
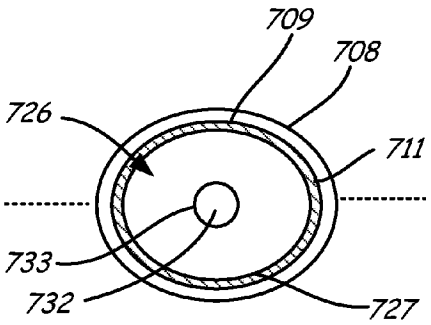
FIG. 26 is a cross-sectional view of the device illustrated in FIG. 25.

FIG. 26 provides a cross-sectional view of plunger assembly 726 and tube 708, under one embodiment. As illustrated, plunger assembly 726 includes a body 727 sized to engage and form a seal with an interior surface 709 of tube 708 to prevent paint in reservoir 706 from leaking past body 727. In one embodiment, a resilient flange 711 formed of elastomeric material, for example, surrounds body 727 and forms an interface between body 727 and the interior surface 709 of tube 708.

Plunger assembly 726 is movably mounted on a threaded shaft 732 extending within tube 708 between ends 728 and 730. Shaft 732 is configured to rotate about an axis to move plunger assembly 726 in either direction 722 or 724. Surfaces 733 of body 727 that engage shaft 732 include corresponding threads. As shaft 732 rotates in either direction, the interaction between the threads causes movement of plunger assembly 726 within tube 708.

Device 700 includes one or more features that prevent shaft 732 from merely spinning the plunger assembly 726 within tube 708, which would otherwise hinder movement of plunger assembly 726 in either direction 722 or 724. In one embodiment, plunger assembly 726 and tube 708 have corresponding non-circular shapes. For example, tube 708 has an oval shape, such as an ellipse, that can be ergonomically appealing to a user, as well as effective in preventing rotation of plunger assembly 726 within tube 708. The oval shape of tube 708 advantageously provides comfortable gripping surfaces for various hand sizes and provides leverage when pressing the roller cover 702 against a painting surface. For example, in one embodiment tube 708 is oriented such that an axis (generally represented in FIG. 26 by dashed line 735) passing through the widest portion of tube 708 (e.g., the major axis in the case of an ellipse) is oriented toward the painting surface when the roller cover 702 is pressed against the painting surface. This orientation provides increased stiffness when pressing the device 700 against a wall, for example, thereby reducing the amount of bending and/or torsion of tube 708.

Alternatively, plunger assembly 726 and/or tube 708 can have other non-circular shapes and can be either symmetrical or asymmetrical. For example, but not by limitation, plunger assembly 726 and/or tube 708 can be in the shape of a square, rectangle, triangle, or other polygon.

Further, it is noted that the non-circular shape described with respect to FIGS. 25 and 26 can be utilized in other types of paint devices to provide ergonomical gripping surfaces and increased tube stiffness when painting. For example, but not by limitation, the non-circular shape described with respect to FIGS. 25 and 26 can be utilized with any type of painting device having a tube forming an internal paint reservoir, including devices that are manually operated by a user.

In one embodiment, the exterior geometry of device 700 can be different than the interior surface 709 of tube 708. For example, the inner and outer surfaces of tube 708 can have different shapes. In another example, tube 708 can be positioned within a second, outer tube having a different size and/or shape.

Figure 27:
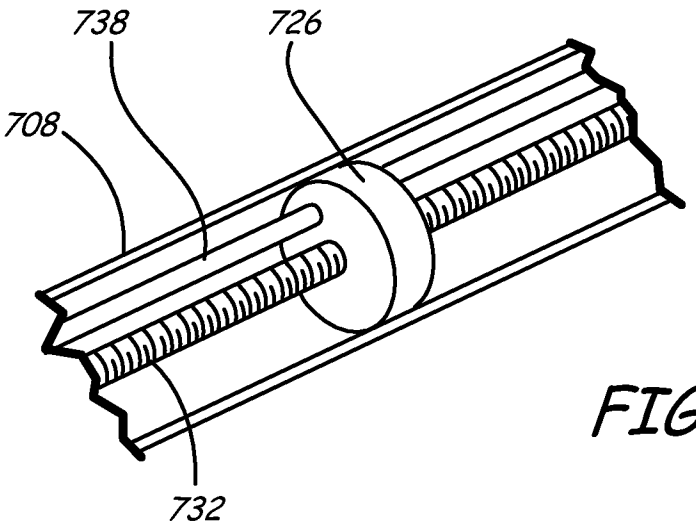
FIG. 27 is a perspective view of a drive mechanism, under one embodiment.

Alternatively, or in addition, one or more guide shafts or rods 738 extending within tube 708 can be received within an aperture formed in plunger assembly 726, as illustrated in the embodiment of FIG. 27, which can be particularly advantageous with circular geometries.

A powered actuator mechanism is provided to impart rotation on shaft 732. In the illustrated embodiment, the actuator mechanism comprises a battery powered tool 740, illustratively in the form of a screwdriver or other similar apparatus. A receptacle 742 formed at end 728 is sized to receive the actuator mechanism 740. For instance, the drive mechanism 720 can be keyed to receive the actuator mechanism 740. A bit 744 or other suitable connector is configured to engage a corresponding connector (generally represented by dashed lines 746) formed at an end of shaft 732.

One or more features are provided to prevent the actuator mechanism 740 from rotating with respect to tube 708. In the illustrative embodiment, a protrusion or tab 748 on actuator mechanism 740 is received within a corresponding recess 750 formed on receptacle 742. Actuator mechanism 740 is secured within receptacle 742 using any suitable attachment mechanisms to prevent inadvertent removal of actuator mechanism 740 from the receptacle 742. Actuator mechanism 740 includes a control, such as a three-position switch, to selectively rotate shaft 732 (i.e., either clockwise or counterclockwise) to move plunger assembly 726 in a desired direction 722 or 724.

Figure 28:
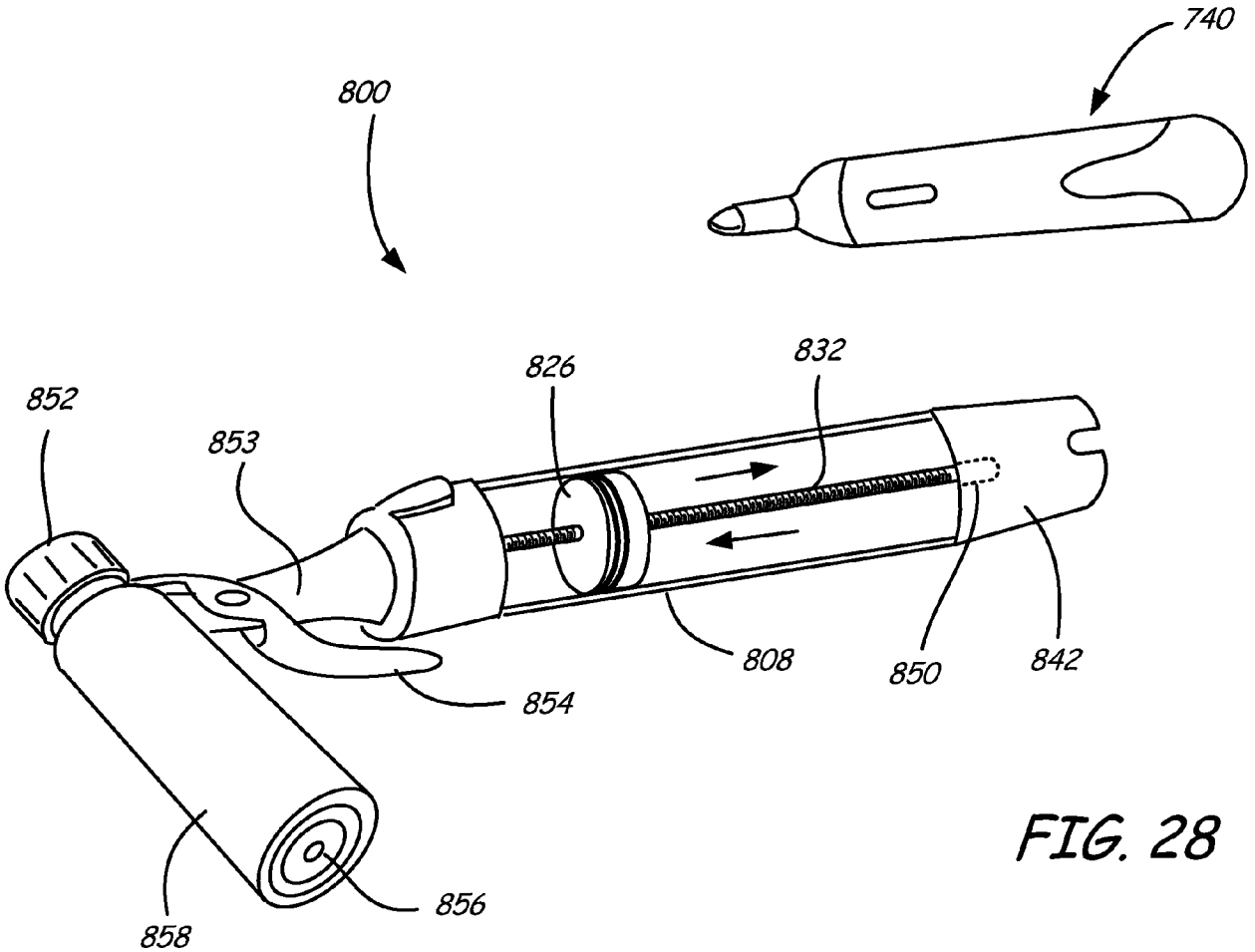
FIG. 28 illustrates a painting device having a powered drive mechanism, under one embodiment.

Actuator mechanism 740 can be configured for interchangeable use with other painting devices having suitable receptacles for operably receiving actuator mechanism 740. For example, other painting devices can include paint applicators such as, but not limited to, brushes and/or pads. FIG. 28 illustrates one particular example of a painting device that can be used with actuator mechanism 740.

As shown in FIG. 28, a paint device 800 comprises a smaller form factor paint roller suitable for edging, trim work, etc. Device 800 includes a plunger assembly 826 that is, in one embodiment, similar to plunger assembly 726 illustrated in FIG. 25. Actuator mechanism 740 is received within a receptacle 842 and engages a connector 850 at an end of shaft 832. A tube 808 can have shapes similar to tube 708 illustrated in FIG. 25.

A roller cover 858 is positioned on a roller core that is rotatably mounted on a roller arm assembly 853. A fill port 852 is provided on a portion of the roller arm assembly 853. A quick release 854 is provided for detaching the roller cover 858 and/or roller core from the roller arm assembly 853. In one embodiment, a round rotating edge disk 856 is provided proximate an end of the roller cover 858.

Figure 29:
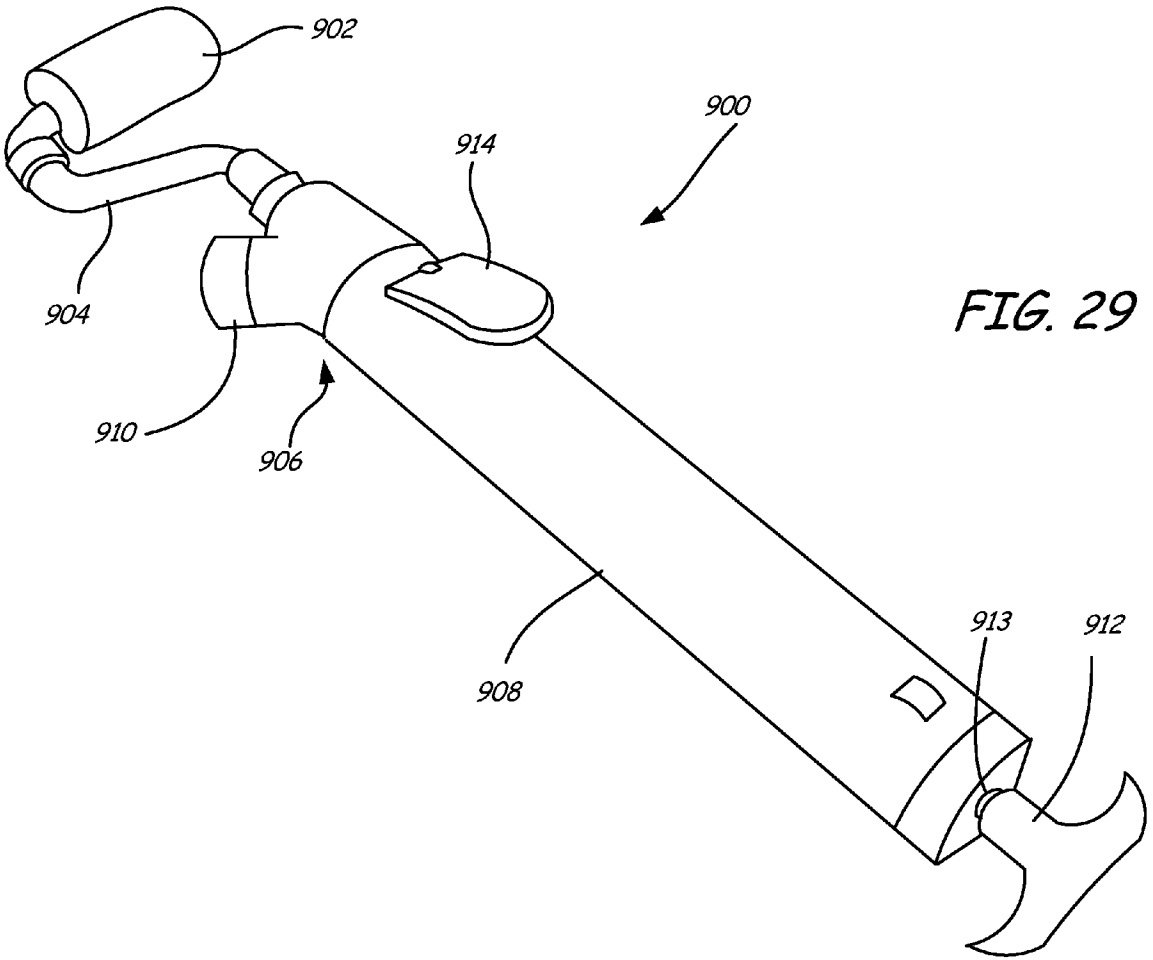
FIG. 29 illustrates a painting device, under one embodiment.

FIG. 29 illustrates one embodiment of a painting device 900 including a roller cover 902 disposed on a roller core that is rotatably mounted on a roller arm assembly 904. Assembly 904 is coupled to a body 906 having a tube 908 forming a paint reservoir. Paint from the paint reservoir is internally fed to roller cover 902 through roller arm assembly 904.

A plunger assembly within tube 908 is operable to drive paint in the paint reservoir through assembly 904. In one embodiment, the plunger assembly is spring loaded using a compression spring, for example. A handle 912 is provided on an end of a rod or shaft 913 and is utilized to retract the plunger assembly when filling device 900 from a fluid container. Retracting the plunger assembly compresses an internal spring (not shown) and expands the paint reservoir which draws paint from the paint container through an inlet port 910. Inlet port 910 is fluidically coupled to the fluid container by a tube, for example.

The plunger assembly is held in the retracted position until a lever 914 is selectively actuated (i.e., depressed) by a user. In one embodiment, lever 914 is operably coupled to a valve mechanism that opens when lever 914 is depressed to allow paint to flow from the paint reservoir. In another embodiment, the lever 914 can be mechanically coupled to the plunger assembly 914.

Figure 30:
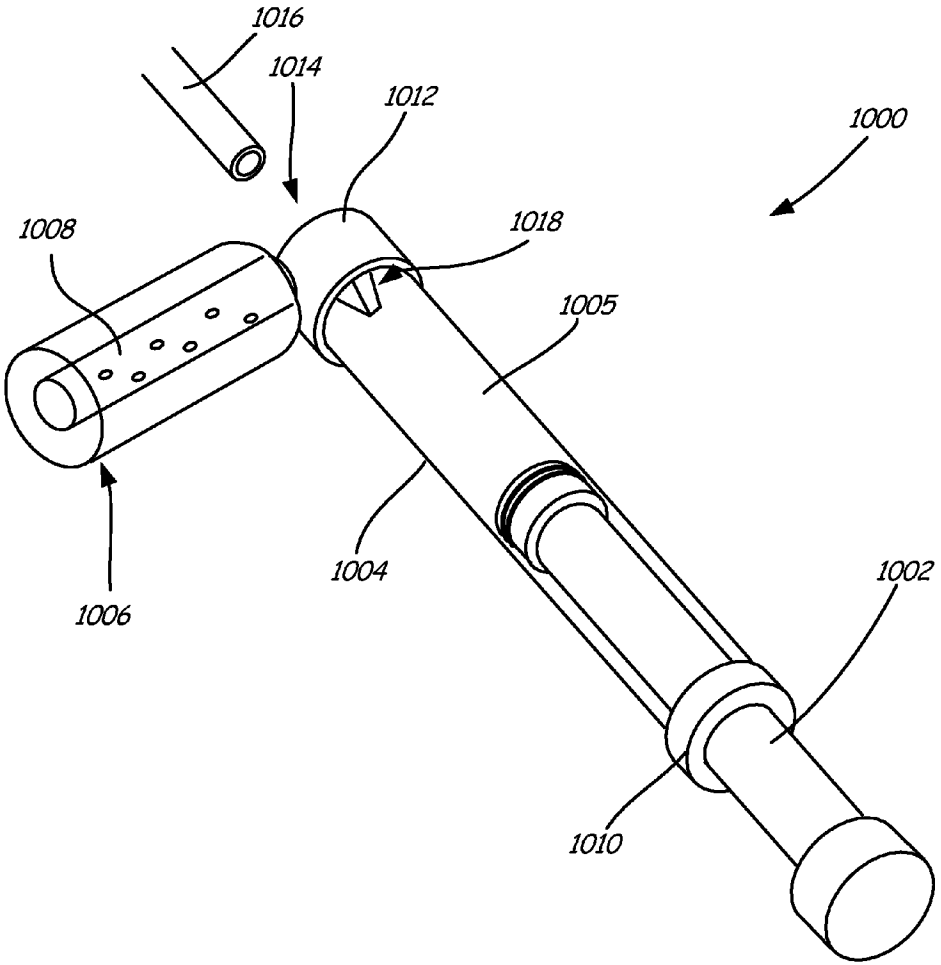
FIG. 30 illustrates a painting device, under one embodiment.

FIG. 30 illustrates one embodiment of a painting device 1000 having an actuator 1002 movable within a tube 1004 forming a paint reservoir 1005. An internally fed roller cover 1006 is mounted on a perforated roller arm 1008. Actuator 1002 is mounted to a first end 1010 of tube 1004 and is manually operated by a user to drive paint from reservoir 1005. A second end 1012 of tube 1004 includes a fill port 1014 configured to receive a tube or syringe 1016 providing paint from a paint container. A valve 1018 (illustratively a duckbill valve) allows an inlet flow of paint through port 1014 to fill reservoir 1005, but prevents paint flow from port 1014 during operation. In the illustrative embodiment, tube 1004 is at least partially formed of transparent material.

Figure 31:
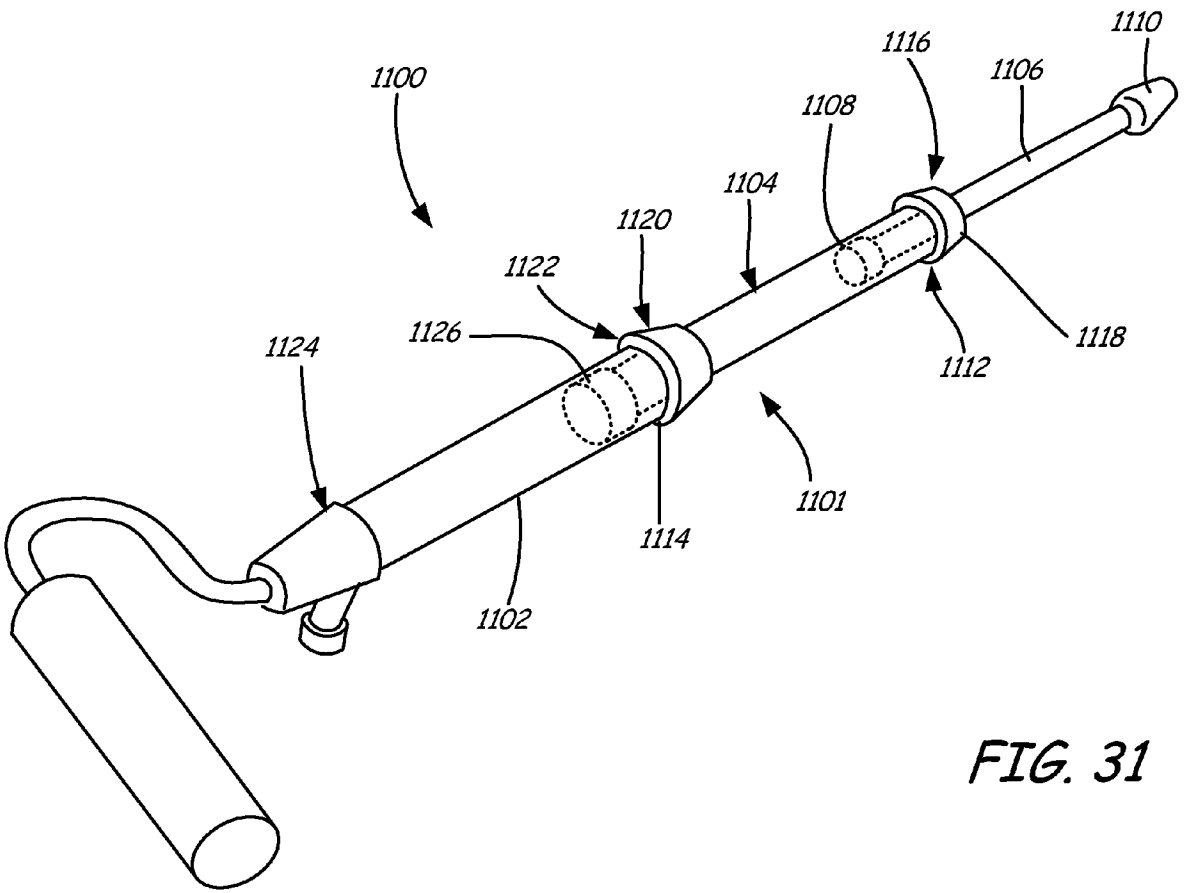
FIG. 31 illustrates a painting device having a telescoping tube, under one embodiment.

FIG. 31 illustrates one embodiment of a painting device 1100 having a telescoping tube 1101. Tube 1101 includes a first tube portion 1102 having a first diameter and a second tube portion 1104 having a second diameter that is smaller than the first diameter. At least a portion of the second tube portion 1104 is movably received within the first tube portion 1102. An interior of each tube portion 1102 and 1104 is hollow forming an expandable paint reservoir. A rod 1106 is positioned within the second tube portion 1104 and includes a plunger assembly 1108 mounted on a first end and a handle 1110 mounted on a second end. Plunger assembly 1108 is sized to engage interior surfaces of tube portion 1104. In one embodiment, a length of rod 1106 from handle 1110 to plunger 1108 is sized such that plunger assembly 1108 is movable from a first end 1112 to a second end 1114 of tube portion 1108.

A collar 1116 is attached to the first end 1112 of tube portion 1104 and is sized to retain the plunger assembly 1108 within tube portion 1104. For example, collar 1116 includes an inner circumferential edge that is smaller than plunger assembly 1108 preventing plunger assembly 1108 from being removed from tube portion 1104. Collar 1116 has an outer edge 1118 that is larger than tube portion 1102. In the illustrated embodiment, collar 1116 is configured to engage a collar 1120 attached to a first end 1122 of tube portion 1102 such that the second end 1114 of tube portion 1104 is movable from the first end 1122 to the second end 1124 of tube portion 1102. The second end 1114 of tube portion 1104 includes a radially extending flange portion 1126. Collar 1120 includes an inner circumferential edge that is smaller than flange portion 1126 to prevent tube portion 1104 from being removed from tube portion 1102.

Alternatively, the second tube portion 1104 can have a larger diameter than the first tube portion 1102 such that the first tube portion 1102 is received within the second tube portion 1104.

Figure 32:
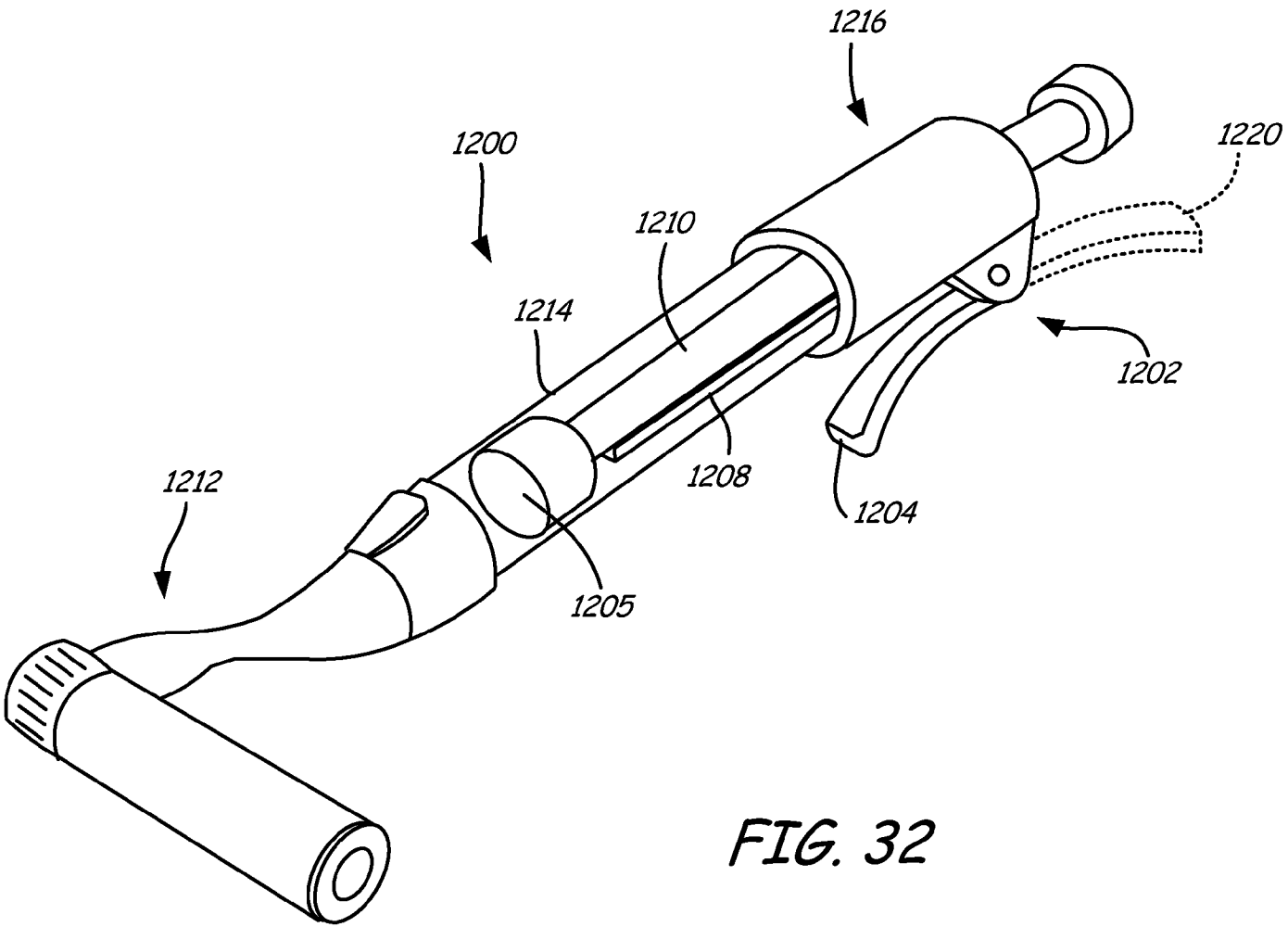
FIG. 32 illustrates a painting device, under one embodiment.

FIG. 32 illustrates one embodiment of a painting device 1200 having a trigger mechanism 1202 for manually driving a plunger assembly 1205 movably positioned within a tube 1214. Trigger mechanism 1202 is illustratively configured to drive plunger assembly 1205 through a rack and pinion gear assembly, although other mechanisms can be utilized. Trigger mechanism 1202 is positioned at an end 1216 of the tube 1214 and includes a pivoting lever 1204. When lever 1204 is depressed by a user, the trigger mechanism 1206 moves a circular gear or pinion that engages teeth on a linear gear or rack 1208 position along rod 1210. In the illustrated embodiment, painting device 1200 has a compact design in which the lever 1204 extends from the pivot point 1206 (shown in FIG. 32) toward the roller arm assembly 1212, as opposed to extending away from the roller arm assembly 1212 (which is illustrated by phantom lines 1220).

Figure 33:
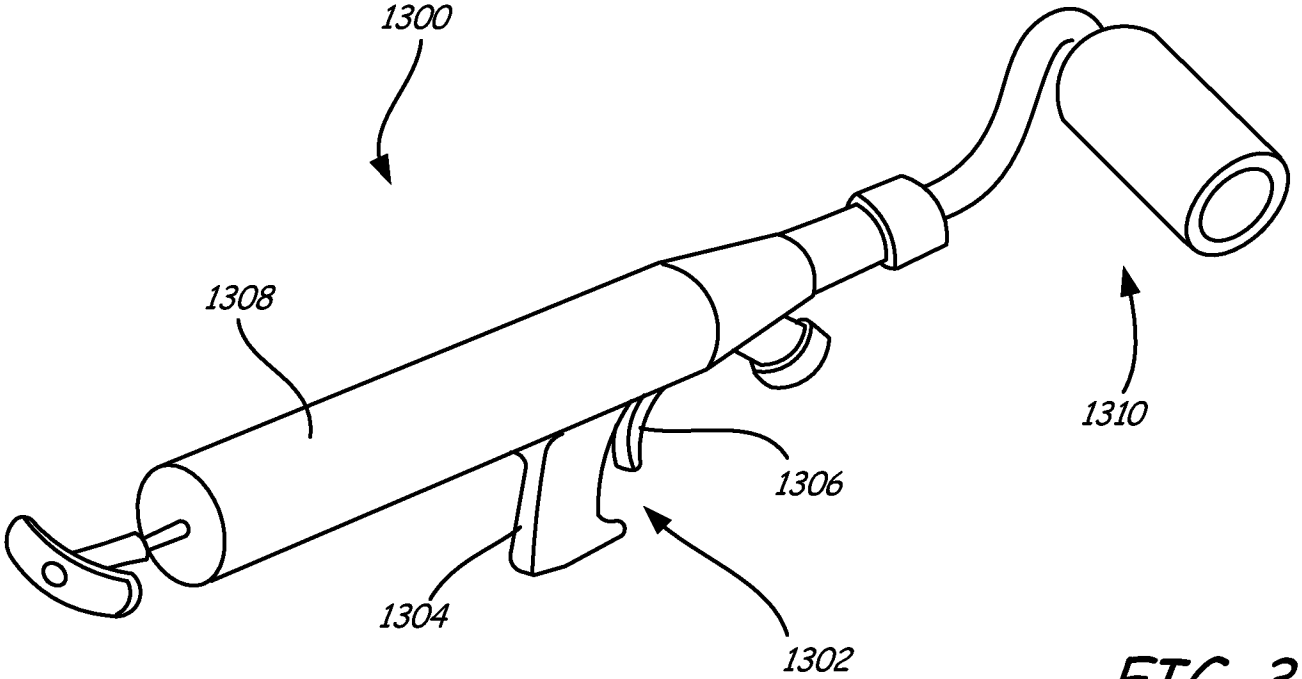
FIG. 33 illustrates a painting device, under one embodiment.

FIG. 33 illustrates one embodiment of a painting device 1300 having a pistol grip 1302 including a downwardly extending handle 1304 adjacent a trigger 1306. In one example, trigger 1306 actuates a rack and pinion gear assembly to advance a plunger assembly and drive paint from tube 1308 to applicator head 1310.

Figure 34:
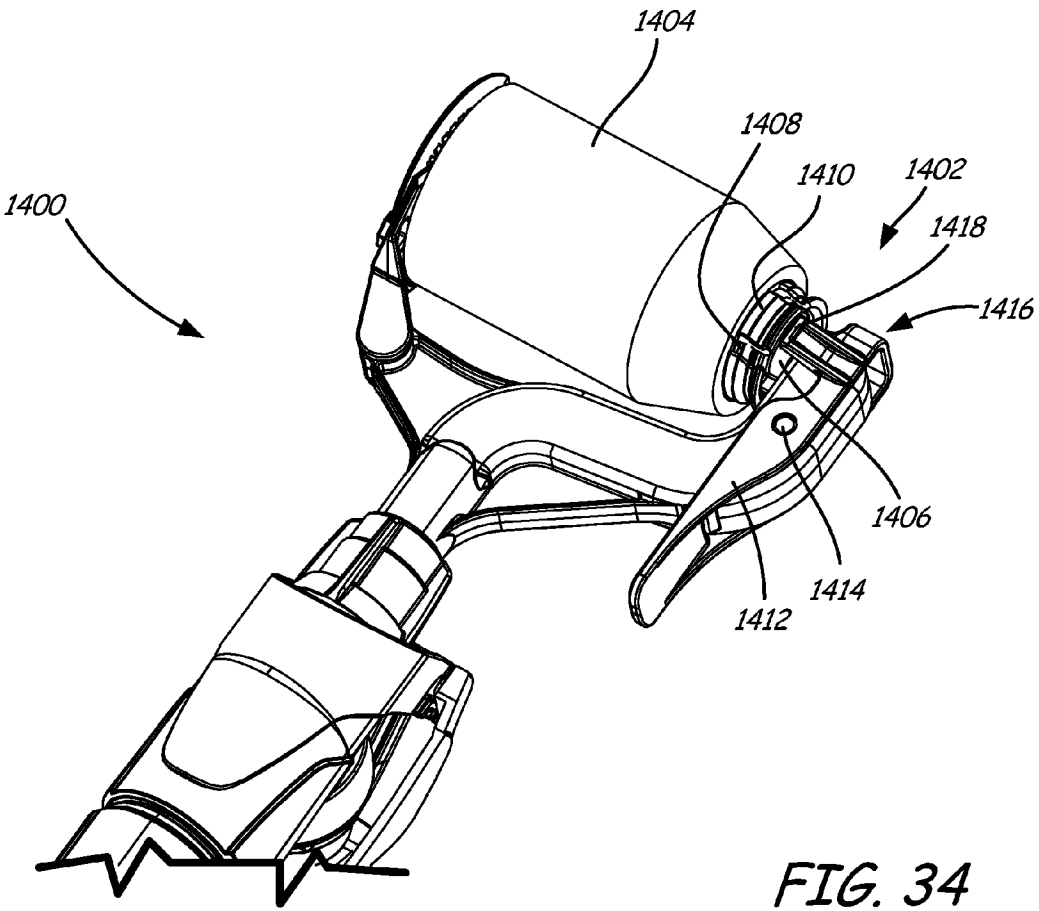
FIG. 34 is a perspective view of a roller assembly having a roller cover quick release mechanism, under one embodiment
Figure 35:
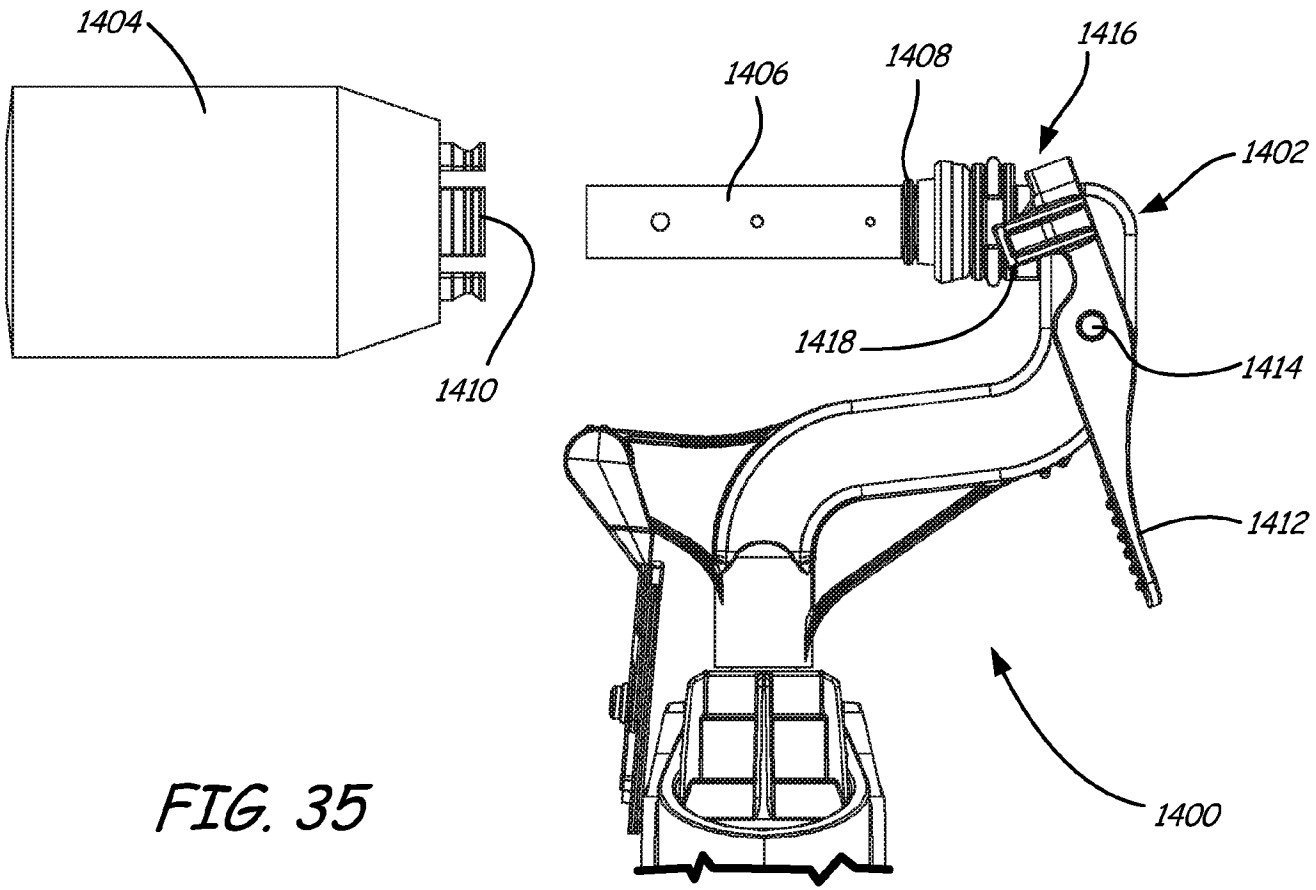
FIG. 35 is a side view of the roller assembly in FIG. 34.

FIG. 34 is a perspective view of a roller assembly 1400 having a roller cover quick release mechanism 1402, under one embodiment. FIG. 35 is a side view of assembly 1400. Mechanism 1402 is configured to release or eject roller cover 1404 from roller core 1404 with requiring the user to physically grasp and apply force directly to roller cover 1404. Roller cover 1404 is retained on core 1406 by a locking mechanism during use. Illustratively, the locking mechanism includes an annular protrusion or ridge 1408 on core 1406 and one or more axial tabs 1410 extending from an end of cover 1404 configured to engage protrusion 1408. Each of tabs 1410 are flexible and include a proximal end attached to cover 1404, a distal end, and a recessed portion configured to accommodate protrusion 1408.

Mechanism 1402 includes lever 1412 pivotable about a pivot point 1414. An end 1416 of lever 1412 is configured to mechanically contact roller cover 1404 and disengage the locking mechanism. Illustratively, lever 1412 includes a portion 1418 extending toward roller cover 1404 to tab 1410 and eject the roller cover 1404 from core 1406.

In accordance with one embodiment, a roller edge guard or shield is provided at an axial end of a roller to prevent the axial end of the roller from contacting an adjacent surface. For instance, in one application a user may desire to paint a top portion of a wall adjacent a ceiling. The edge guard or shield aids the user when painting the wall along the ceiling by preventing the roller from contacting the ceiling.

Figure 37:
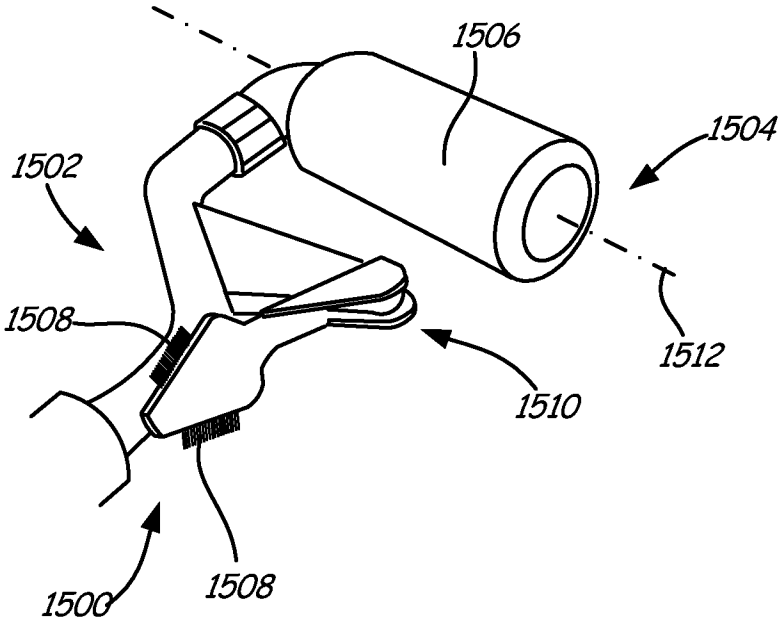
FIGS. 36 and 37 are perspective views of a roller edge guard, under one embodiment.
Figure 36:
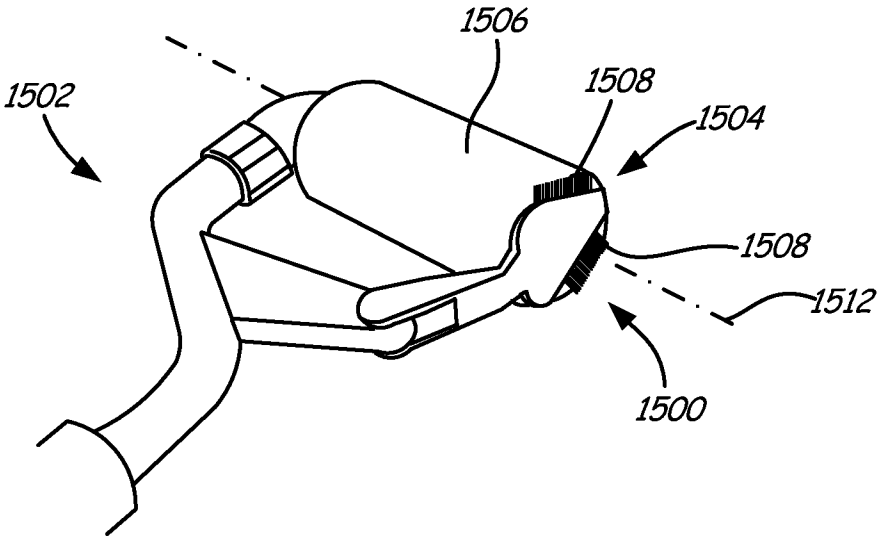

FIGS. 36 and 37 illustrate one embodiment of a roller shield 1500 configured for use with a paint roller device, such as, but not limited to, the paint roller devices discussed above. Roller shield 1500 is mounted on a roller arm assembly 1502 of the device. Shield 1500 is pivotable between a first position (shown in FIG. 36) in which the shield 1500 is proximate the axial end 1504 of the roller 1506 and a second position (shown in FIG. 37) in which the shield 1500 is spaced from the axial end 1506. The shield 1500 can be biased to the first position, for example using a spring or other suitable mechanism, to maintain the shield 1500 in close proximity to the axial end 1504 of the roller 1506. Alternatively, or in addition, a locking mechanism 1510, such as a pin, can be provided to lock the shield 1500 in either the first or second positions.

The shield 1500 can also include one or more brushes 1508 comprising a plurality of bristles, for example, extending from edges of shield 1500. The brushes 1508 are configured to contact a portion of the surface to be painted in very close proximity to the adjacent surface. While an exemplary brush is illustrated herein as including bristles, it is understood that other suitable tools or implements can be utilized. For example, a brush can include a substantially flat pad or disc formed of suitable material such as, but not limited to, foam, fabric, etc.

In the example illustrated in FIG. 36, shield 1500 includes a pair of brushes positioned on opposite edges of shield 1500. A first brush is positioned on a first side of roller axis 1512 and a second brush is positioned on a second side of roller axis 1512. In this manner, either of the brushes can be used to paint along an adjacent surface depending on the orientation of the paint device (i.e., whether the device is held with the shield on the left side or the right side).

When a pair of edge guard brushes are utilized, it may be the case that the brush that is not be used to paint the surface (i.e., the brush facing way from the surface to be painted) can inadvertently contact the adjacent surface leaving undesirable paint marks and/or imperfections in paint applied to the adjacent surface. In accordance with one embodiment, an edge guard or shield is provided having a movable or rotatable brush feature.

Figure 38:
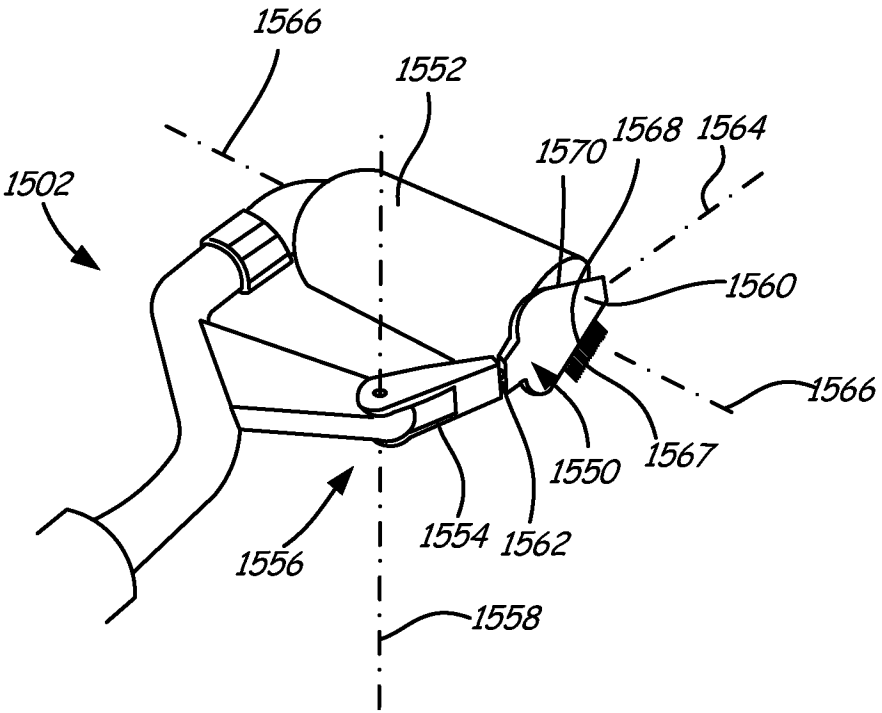
FIG. 38 is a perspective view of a roller edge guard, under one embodiment.

FIG. 38 illustrates one embodiment of a roller edge guard or shield 1550 configured for use with a paint roller device, such as, but not limited to, the paint roller devices discussed above. Shield 1550 is pivotable between a first position in which the shield 1550 is proximate an axial end of the roller 1552 and a second position in which the shield 1550 is spaced from the axial end. Guard 1550 has an arm 1554 that is pivotable at a pivot 1556 about an axis 1558. An adjacent wall engaging head 1560 is rotatably attached to arm 1554 at a pivot 1562. Head 1560 is rotatable about a second axis 1564 which is, in one embodiment, substantially perpendicular to an axis 1566 of roller 1552. At least one brush 1567 comprising a plurality of bristles, for example, is provided on one edge 1568 of head 1560. An opposite edge 1570 does not include a brush feature. Head 1560 is rotatable by the user such that the brush 1567 is selectively positionable in a first orientation in which brush 1567 is on a first side of roller axis 1566 and a second orientation in which brush 1567 is on a second, opposite side of roller axis 1566.

Figure 39:
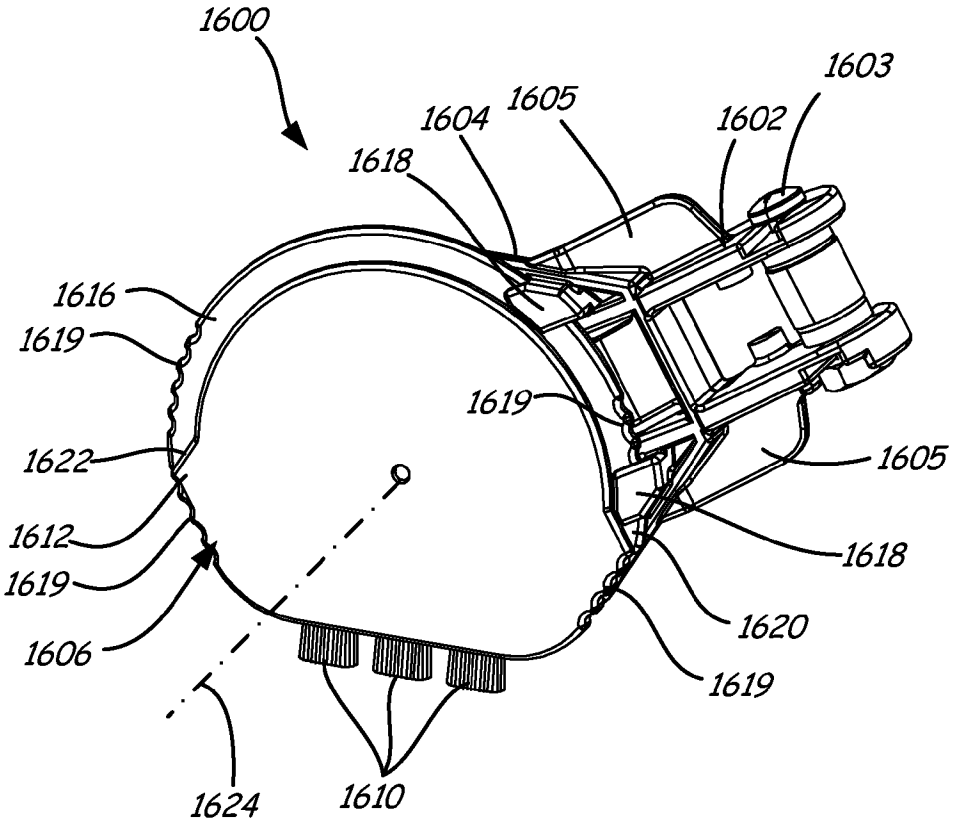
FIGS. 39 and 40 are perspective views of a roller edge guard, under one embodiment.
Figure 40:
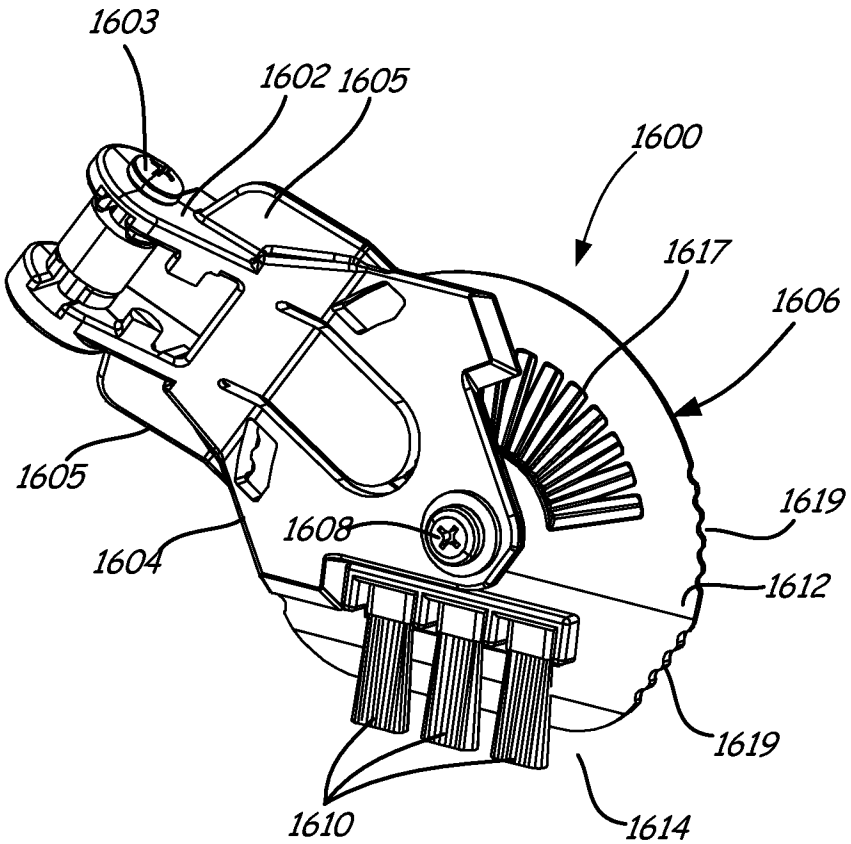

FIGS. 39 and 40 illustrate another embodiment of an edge guard or shield 1600 having a movable brush feature configured for use with a paint roller device, such as, but not limited to, the paint roller devices discussed above.

Guard 1600 has a first arm portion 1602 that is configured to attach to a painting device using a screw fastener 1603 and be rotated about a pivot point, such as pivot point 1556 illustrated in FIG. 38. Shield 1600 is pivotable between a first position in which the shield 1600 is proximate an axial end of the roller and a second position in which the shield 1600 is distant from the axial end. In the illustrated embodiment, first arm portion 1602 includes one or more laterally extending wings 1605 that provide gripping surfaces for a user when pivoting guard 1600. Wings 1605 are positioned such that the user is less likely to get paint on their hands when moving guard 1600.

A second head portion 1604 extends from arm portion 1602 and rotatably supports a brush assembly 1606. Brush assembly 1606 includes at least one brush 1610 comprising a plurality of bristles, for example, attached to a plate 1612 and extending beyond and edge 1614 of plate 1612.

In the illustrated embodiment, brush assembly 1606 is rotatably coupled to head portion 1604 using a screw 1608. Plate 1612 has a recessed portion 1616 that is received by a pair of guides 1618. Guides 1618 are positioned to act as rotational limiters or stops for plate 1612. That is, a first raised portion 1620 of plate 1612 contacts one of the guides 1618 at a first rotational limit and a second raised portion 1620 of plate 1612 contacts one of the guides 1618 at a second rotational limit. Alternatively, or in addition, detent features 1617 can be provided to aid in the rotational positioning of plate 1612 and discourage inadvertent movement of plate 1612 during operation. Also, one or more protrusions and/or indentations 1619 can be provided along an edge of plate 1619 to aid the user in gripping plate 1612 for rotation.

Brush assembly 1606 is rotatable with respect to arm portion 1602 about an axis 1624. In one embodiment, when guard 1600 is positioned proximate the axial end of the roller, axis 1624 is substantially parallel to the roller axis.

Figure 42:
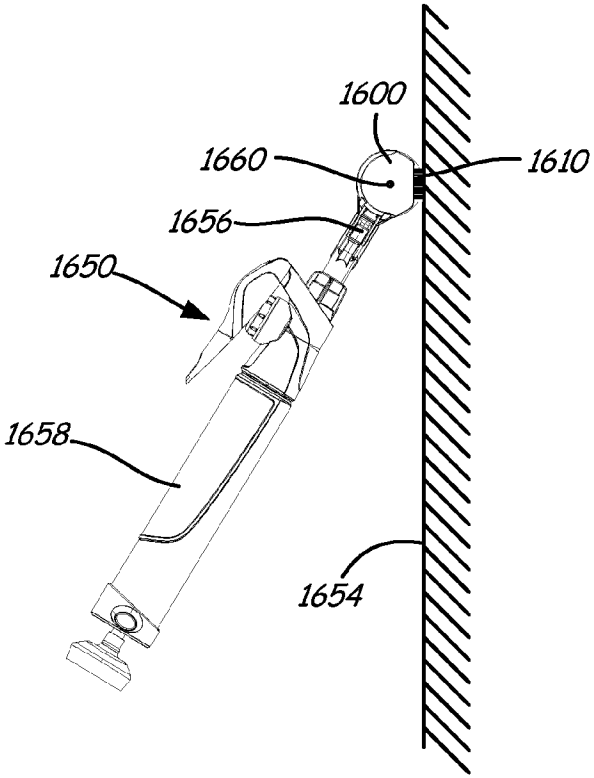
FIGS. 41 and 42 are side views illustrating an exemplary painting device using the roller edge guard of FIG. 39.
Figure 41:
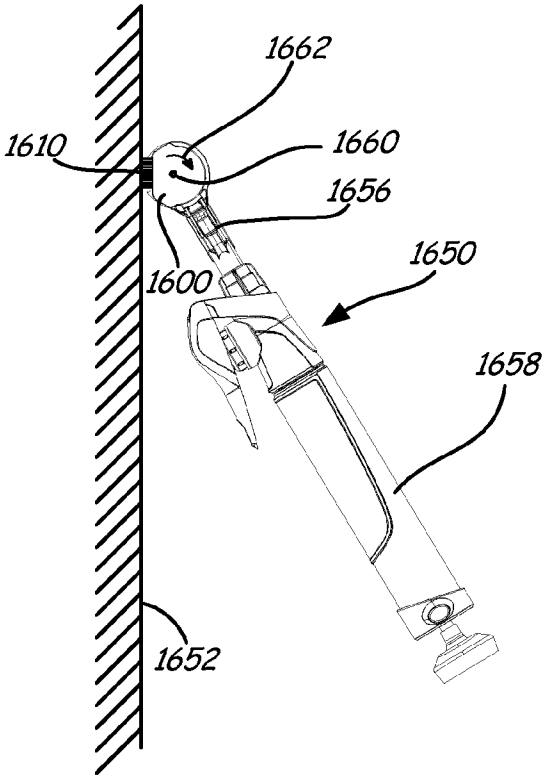

FIGS. 41 and 42 illustrate guard 1600 attached to a painting device 1650 for painting exemplary wall surfaces 1652 and 1654. In one embodiment, device 1650 is substantially similar to painting device 100 illustrated with respect to the FIG. 1. Guard 1650 is rotatably connected to a roller arm assembly 1656 and is positioned on a first side 1658 of device 1650. In FIG. 41, the brush assembly of guard 1600 is in a first position in which brush 1610 is on a first side of the roller axis (represented by point 1660). In FIG. 42, the brush assembly of guard 1600 has been rotated in a direction represented in FIG. 41 by arrow 1662 such that brush 1610 is on a second, opposite side of roller axis 1660. Illustratively, guard 1600 is on a left-hand side of the painting device 1650 in FIG. 41 and is on a right-hand side of the painting device 1650 in FIG. 42. In this manner, brush 1610 can be used to paint along an adjacent surface (adjacent to surfaces 1652 or 1654) regardless of whether the painting device is held with the edge guard on the user's left-hand side or right-hand side.

Figure 43:
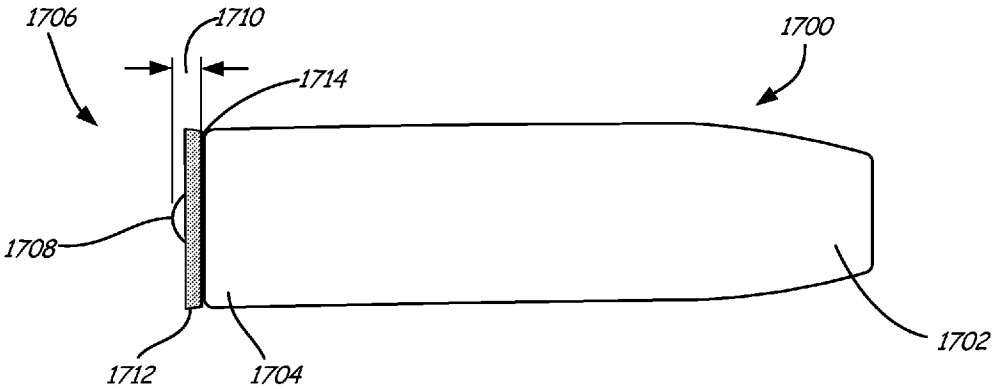
FIGS. 43 and 44 are side and perspective views, respectively, of a roller cover, under one embodiment.
Figure 44:
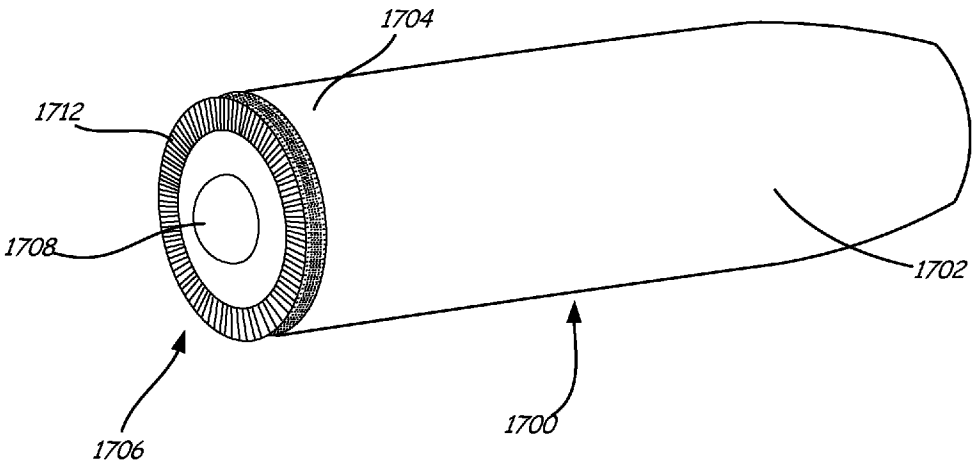

FIGS. 43 and 44 illustrate one embodiment of a roller cover 1700 having an attached edging assembly. Roller cover 1700 has a tapered portion 1702 that provides a feathered paint edge and a substantially non-tapered portion 1704. An edging assembly 1706 is attached to an axial end 1714 of roller cover 1700 and includes an edge contact 1708 configured to contact an adjacent surface (e.g., wall or ceiling), adjacent to a surface to be painted, to maintain a desired spacing (generally represented by arrow 1710) between the adjacent surface and the axial end 1714 of the roller cover 1700. The edge contact 1708 can be formed of any suitable material such as, but not limited to, rubber or plastic, and can have any suitable shape. A radially extending brush 1712 is also provided to contact a portion of the surface to be painted in close proximity to the adjacent surface.

Figure 45:
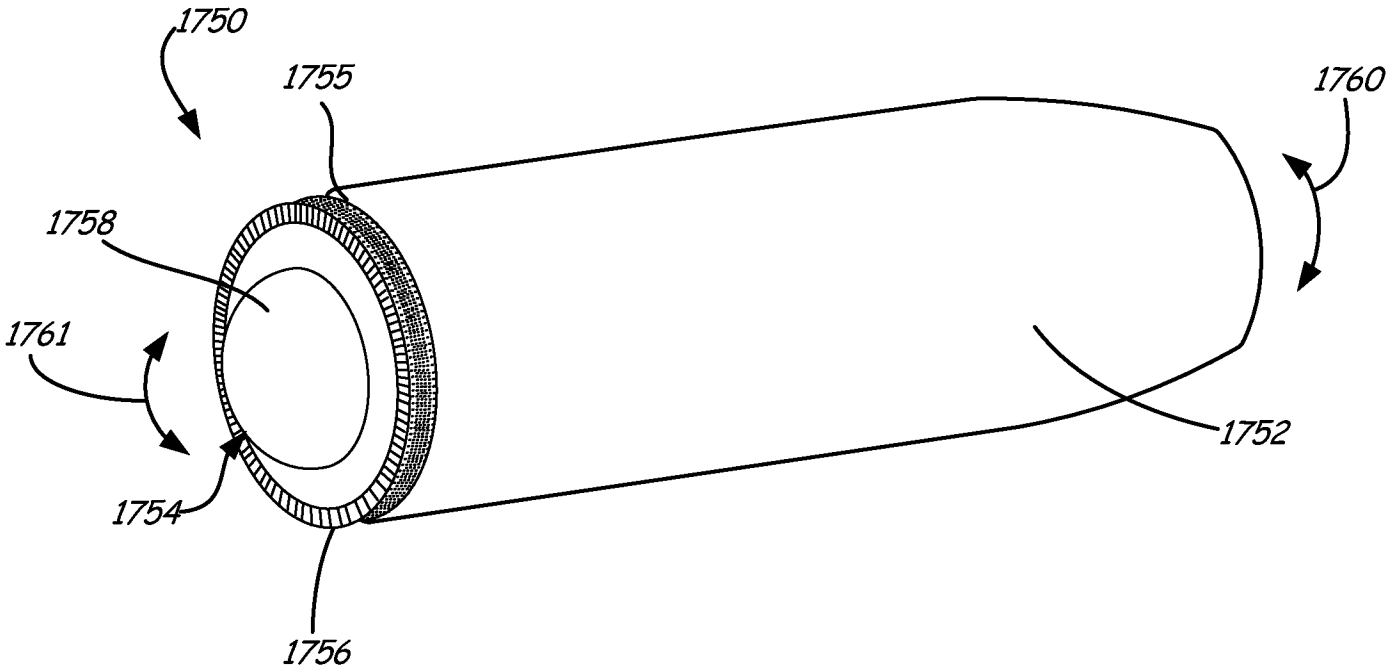
FIG. 45 is a perspective view of a roller cover, under one embodiment.

FIG. 45 illustrates one embodiment of a roller cover 1750 having a tapered portion 1752. An edge guide 1754 is attached to an axial end 1755 of roller cover 1750. Edge guide 1754 includes a substantially spherical rolling ball 1758 configured to maintain a desired distance between the axial end 1755 of roller cover 1750 and an adjacent surface, such as a wall or ceiling. Edge guide 1754 also includes a radially extending brush 1756. In one embodiment, edge guide 1754 is removably attached to roller cover 1750, and can be removed for cleaning and/or replacement.

Spherical ball 1758 is partially retained within and protrudes through a circular opening formed in the axial end 1755 of roller cover 1750. In one embodiment, ball 1758 and axial end 1755 comprise a ball and socket in which ball 1758 is configured to rotate independently of roller cover 1750 about any of a number of different axes having a common center or intersection point. Ball 1758 engages the adjacent surface causing rotation of ball 1758 in a first direction (illustrated by double arrow 1761) as roller cover 1750 rotates in a second direction (illustrated by double arrow 1760).

Figure 46:
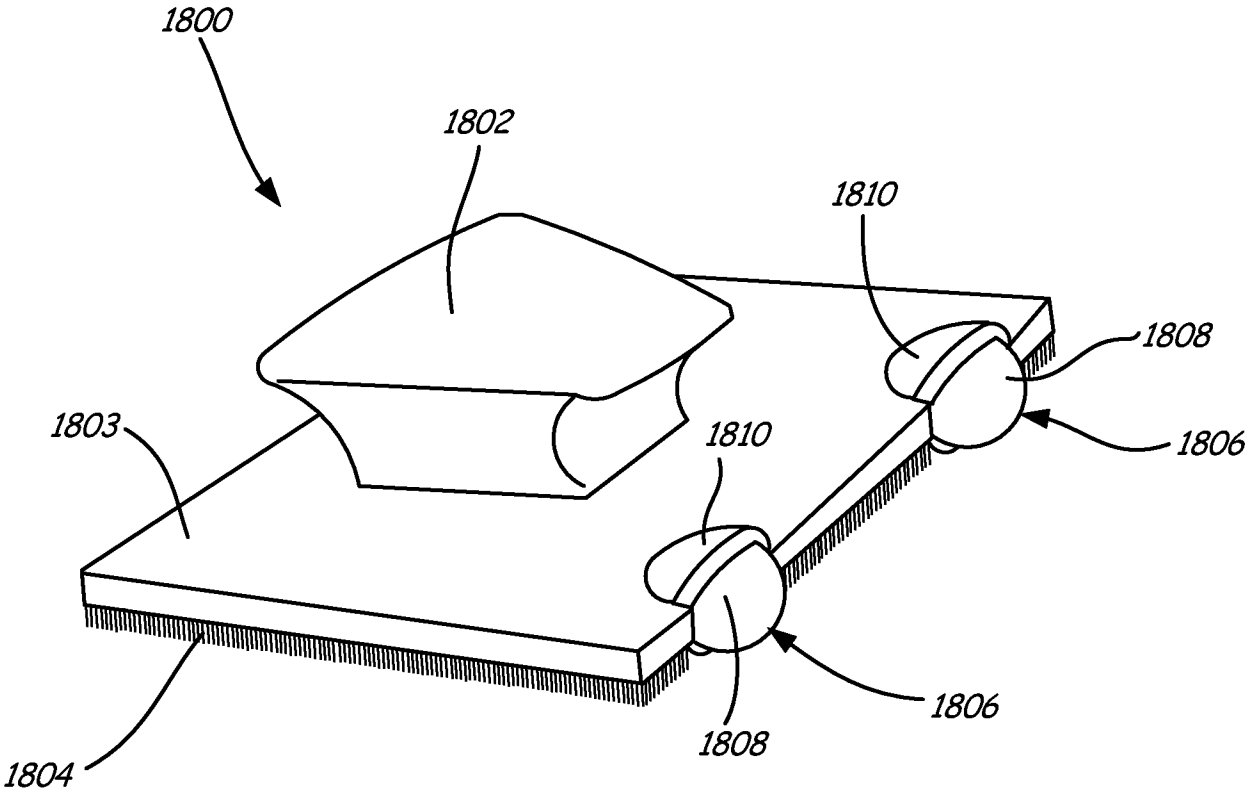
FIG. 46 is a perspective view of a painting device having a paint pad, under one embodiment.

FIG. 46 illustrates one embodiment of a painting pad 1800 having a handle 1802 extending from a base 1803 and a pad material 1804 for applying paint to a surface. Pad 1800 includes one or more edge guides 1806 comprises substantially spherical rolling balls 1808 rotatably mounted within receptacles 1810 formed in base 1803.

Although the present invention has been described with reference to preferred embodiments, workers skilled in the art will recognize that changes may be made in form and detail without departing from the spirit and scope of the invention.

What is claimed is:

1. A paint roller apparatus comprising:

a paint roller rotatably mounted on a roller arm; and a paint roller shield comprising:

a first portion coupled to the roller arm; and a second portion comprising a plate rotatably coupled to the first portion and a brush assembly attached to the plate, wherein the plate has a recessed portion that is received by a pair of guides that are positioned to act as rotational limiters for the plate, and further wherein the pair of guides are configured such that they allow limited rotation of the brush assembly to between a first and second position relative to the roller arm, through a series of discrete intermediary positions, wherein the first position is on one side of a roller axis and the second position is on the other side of the roller axis and wherein each of the series of discrete intermediary positions includes a mechanical stop to lock the brush assembly in position.

2. The paint roller apparatus of claim 1, wherein the first portion is rotatably couplable to the roller arm.

3. The paint roller apparatus of claim 1 wherein the plate further comprises at least one detent feature that affects rotation of the plate with respect to the first portion.

4. The paint roller apparatus of claim 1 wherein the plate further comprises protrusions along an edge of the plate.

5. The paint roller apparatus of claim 1 wherein the first portion further comprises laterally extending wings.

6. The paint roller apparatus of claim 1, and further comprising a locking feature configured to selectively lock a head when it is spaced away from the end of the roller in a position at the first position, at the second position, or between the first position and the second position.

* * * * *